US009348287B2

(12) United States Patent
Hara et al.

(10) Patent No.: US 9,348,287 B2
(45) Date of Patent: May 24, 2016

(54) DETECTING DEVICE AND IMAGE FORMING APPARATUS

(71) Applicant: CANON KABUSHIKI KAISHA, Tokyo (JP)

(72) Inventors: Seiji Hara, Tokyo (JP); Mineto Yagyu, Hachioji (JP); Masaya Kobayashi, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/590,054

(22) Filed: Jan. 6, 2015

(65) Prior Publication Data

US 2015/0192885 A1 Jul. 9, 2015

(30) Foreign Application Priority Data

Jan. 7, 2014 (JP) ..... 2014-001050

(51) Int. Cl.
*G03G 15/00* (2006.01)

(52) U.S. Cl.
CPC ..... *G03G 15/5037* (2013.01)

(58) Field of Classification Search
CPC ..... G03G 15/5037; G03G 2215/00054
USPC ..... 399/48
See application file for complete search history.

(56) References Cited

U.S. PATENT DOCUMENTS 4,724,393 A * 2/1988 Kumada et al. ..... 324/458

FOREIGN PATENT DOCUMENTS

| | | | |
|---|---|---|---|
| JP | S56108964 | A | 8/1981 |
| JP | H08201461 | A | 8/1996 |
| JP | 2008128981 | A | 6/2008 |
| JP | 201113431 | A | 1/2011 |

* cited by examiner

*Primary Examiner* — David Bolduc
*Assistant Examiner* — Barnabas Fekete
(74) *Attorney, Agent, or Firm* — Fitzpatrick, Cella, Harper & Scinto

(57) ABSTRACT

A detecting device for detecting a surface potential of a photosensitive member includes a first electrode adapted to be positioned with a space relative to a surface of the photosensitive member; a second electrode adapted to be positioned relative to the surface of the photosensitive member at the distance from the first electrode away from the surface; a first detecting portion configured to detect induced charge in the first electrode; a second detecting portion configured to detect induced charge in the second electrode; a calculating portion configured to calculate a surface potential of the photosensitive member on the basis of an output of the first detecting portion and an output of the second detecting portion.

10 Claims, 17 Drawing Sheets

(a)

(b)

(a)

(b)

(a)

(b)

(a)

(b)

(a)

(b)

(a)

(b)

DETECTING DEVICE AND IMAGE FORMING APPARATUS

FIELD OF THE INVENTION AND RELATED ART

The present invention relates to a detecting device and an image forming apparatus provided with the same.

In an electrophotographic type image forming apparatus, a photosensitive member is uniformly charged by a charging device, and then the photosensitive member is exposed to image light so that an electrostatic latent image is formed on the photosensitive member. Thereafter, a toner image is formed on the photosensitive member by a developing device, and the toner image is transferred onto a sheet (recording material) by a transferring device.

Here, as for technique for stabilizing an image quality, the following is known. A potential of the photosensitive member is measured, and in accordance with the detecting potential, the charging device and/or the exposure device is controlled to make the potential of the photosensitive member closer to the target potential so as to start is the image. The potential of the photosensitive member includes a charged potential (Vdark and Vd) of the photosensitive member and a light portion potential (Vlight and Vl) of the photosensitive member exposed by the exposure device.

As for the method for measuring the potential of the photosensitive member, there is a so-called electrostatic capacity type potential sensor with which an electroconductive probe is disposed adjacent to the photosensitive member, and the current introduced in the electroconductive probe depending on the potential of the photosensitive member is detected to determine the potential of the photosensitive member.

The electrostatic capacity type potential sensor is classified into an electrostatic capacity changing the type in which the electrostatic capacity between the electroconductive probe and in the photosensitive member is positively changed, and an electrostatic capacity fixed type in which the electrostatic capacity between the electroconductive probe and the photosensitive member is not changed.

Furthermore, the electrostatic capacity changing type potential sensor includes two types.

In one of them, as shown in part (a) of FIG. 20, an electroconductive shutter is provided between the electroconductive probe and the photosensitive member, and the electrostatic capacity is changed by opening and closing the shutter (shutter type).

In another type, as shown in part (b) of FIG. 20, the electroconductive probe is vibrated in the direction toward and away from the photosensitive member, by which the electrostatic capacity is changed.

The principle equations of the shutter type and the probe vibration type are as follows:

$$i = \frac{dQ}{dt} = V \cdot \frac{dC}{dt} \tag{1}$$

Where i is an induced current through the electroconductive probe, Q is an induced charge of the electroconductive probe, V is a potential difference between the electroconductive probe and the photosensitive member, C is an electrostatic capacity between the electroconductive probe and the photosensitive member. As will be understood from equation (1), an induced current i is detected corresponding to the potential difference V a change amount dC/dt of the electrostatic capacity, by the electroconductive probe. The potential of the probe and in the change amount dC/dt of the electrostatic capacity a predetermined, and therefore, by analyzing the induced current i, the potential difference V that is the potential of the photosensitive member is calculated.

The shutter type will be considered.

As shown in part (a) of FIG. 20, in the shutter type, when the distance between the electroconductor probe and the photosensitive member is d0, a dielectric constant of vacuum is ∈0, an area of the electroconductor probe is S, the induced current i it is expressed by the following equation $$i = V \cdot \frac{dC}{dt} = V \cdot \frac{\varepsilon_0}{d_0} \cdot \frac{dS}{dt} \tag{2}$$

As will be understood from equation (2), the induced current i changes with a distance d0 between the electroconductive probe and the photosensitive member and electroconductive probe area change amount dS/dt as well as the potential difference V. The area change amount dS/dt can be stably acquired using a shutter constituting a tuning fork which has a predetermined inherent frequency. That is, in order to calculate the photosensitive member potential by detecting and analyzing the induced current i, it is required to acquire the distance d0.

The probe vibration type will be described. In the probe vibration type shown in part (b) of FIG. 20, the distance between the electroconductive probe and the photosensitive member is d0+d sin (ωt), where d0 is an average distance between the electroconductive probe and the photosensitive member, d is a vibration amplitude of the probe, and ω is a frequency of the vibration. Therefore, the induced current i is expressed by the following equation (3):

$$i = V \cdot \frac{dC}{dt} = V \cdot \varepsilon_0 S \cdot \frac{d}{dt}\left(\frac{1}{d_0 + d\sin(\omega t)}\right) = -V \cdot \varepsilon_0 S \cdot \frac{d\omega\cos(\omega t)}{(d_0 + d\sin(\omega t))^2} \tag{3}$$

As will be understood from equation (3), the induced current i change is with the average distance d0, a probe vibration amplitude d, the vibration frequency ω and the area S as well as the potential difference V. The probe vibration amplitude d, the vibration frequency ω and the area S may be stably acquired by driving the electroconductive probe by a piezoelectric element, for example. That is, in the probe vibration type, in order to calculate the photosensitive member potential, it is particularly required to a quiet the average distance d0. This, in order to stably determining the show of the photosensitive member in the shutter type and probe vibration type, the distance d0 between the electroconductive probe and the photosensitive member is required to be acquired.

In the electrophotographic apparatus, the photosensitive member is a seamless drum (photosensitive drum) to stably output a continuous image. The photosensitive drum may make an eccentric rotation (several tens μm) due to errors during machining and mounting. Therefore, when the potential of the photosensitive drum is detected using the shutter type or the probe vibration type, there is a distance dependence problem, that is, the potential of the photosensitive drum is not correctly determined because the distance between the photosensitive drum and the electroconductive probe changes.

In order to provide a solution to the problem of the distance dependence, various proposals have been made. First, Japanese Laid-open Patent Application Hei 8-201461 proposes a method in which the output of the shutter type or probe vibration type potential sensor is corrected. In this method, two or more reference voltages are applied to the electroconductive base layer of the photosensitive member, and the outputs of the potential sensor are calculated two determines a correction line between the reference voltage vs. potential sensor output. At the time of measurement of the potential, the electroconductive base layer of the photosensitive member is electrically grounded using the switch, and the output of the potential sensor is covered to the potential of the photosensitive member using the thus determined correction line.

The variation of the distance between the electroconductive probe and the object of measurement is determined beforehand, that is, upon the shipment, for example, and the output of the potential sensor is corrected in accordance with the variation of the distance.

In addition, a relationship between a temperature change and the distance variation is also detected beforehand, so that the distance between the electroconductive probe and the object is calculated using the temperature sensing value of the inside of the image forming apparatus, and the output of the potential sensor is corrected in accordance with the corrected distance (Japanese Laid-open Patent Application 2008-128981).

Japanese Laid-open Patent Application Sho 56-108964 discloses a zero point method. In this prior art, the shutter is closed and opened to change an electrostatic capacity between the electroconductive probe and the photosensitive member, and the induced current is detected. In this case, the induced current is not produced when the potential difference between the photosensitive member and the electroconductive probe and the shutter is 0V. Using this principle, a voltage is applied to the electroconductive probe and the shutter and is increased gradually so that the induced current becomes 0, and the applied voltage at the time when the induced current becomes 0 is outputted as the surface potential of the photosensitive member. With this structure, the surface potential of the photosensitive member can be calculated without the dependency on the distance between the electroconductive probe and the photosensitive member.

However, with the Japanese Laid-open Patent Application Hei 8-201461, the output of the potential sensor is corrected when the photosensitive drum does not rotated, and therefore, the dynamic change such as the eccentric motion of the photosensitive drum is not taken into account. Therefore, the correction timing and the operation timing a different from each other, and therefore, the distance between the photosensitive drum and the potential sensor when the correction is made is different from that when the measurement is effected, and for this reason, the distance dependence is not corrected accurately. Even if the correction is made at several points with respect to the rotational direction of the photosensitive drum taking the dynamic change into account, for example, a high precision encoder for acquiring the phase of the photosensitive drum is required with the result of complications of the structure. Furthermore, the correction has been made each time of a gradual position variation of the photosensitive drum and/or the potential sensor attributable to the temperature rises of the apparatus, and therefore, the throughput (printing number per unit time) of the device decreases significantly.

Furthermore, with the Japanese Laid-open Patent Application 2008-128981, even if the variation of the distance between the electroconductive probe and the object is stored beforehand, the distance dependence cannot be accurately corrected when the gradual positional change of the photosensitive drum or the potential sensor attributable to the gradual temperature rise of the apparatus.

In addition, similarly to the case of Japanese Laid-open Patent Application Hei 8-201461, the phase of the photosensitive drum has to be stored when the distance variation is stored, and therefore, the high precision encoder is required with the result of complications and increase in cost.

With Japanese Laid-open Patent Application Sho 56-108964, a shutter mechanism and high voltage circuit is required for the potential sensor with the result of complications of the structure. In order to reduce the time required for the potential measurement, a high responsivity high voltage circuit is desirable, but such a high voltage source is expensive. In reality, from the standpoint of the cost, the ordinary high voltage source has a response time of approx. 60 [msec] for 1 [kV] rise. With this response time, when the speed of the surface of the photosensitive drum is 300 [mm/sec], the result is 300 [mm/sec]×60 [msec]=18 [mm] on the photosensitive drum.

If the distance between the electroconductor probe and the photosensitive drum is 2 [mm], a detection range of the electroconductor probe is approx. 15 [mm] on the photosensitive drum, and the range required for the potential measurement on the photosensitive drum is 18 [mm]+15 [mm]=33 [mm]. For the purpose of high accuracy potential measurement, an average of a plurality of measurements, the influence of the response time is significant, and in the image forming operation as to be interrupted for the period corresponding to the 33 [mm]×the measurement number.

However, the potential sensor using the zero point method is used ordinarily during an adjustment period in which the printing operation is at rest, that is, preparation time before the printing operation, for example, and therefore, the potential of the photosensitive drum during the image forming operation cannot be carried out in real time.

SUMMARY OF THE INVENTION

According to an aspect of the present invention, there is provided a detecting device for detecting a surface potential of a photosensitive member, said detecting device comprising a first electrode adapted to be positioned with a space relative to a surface of the photosensitive member; a second electrode adapted to be positioned relative to the surface of the photosensitive member at the distance from said first electrode away from the surface; a first detecting portion configured to detect induced charge in said first electrode; a second detecting portion configured to detect induced charge in said second electrode; a calculating portion configured to calculate a surface potential of the photosensitive member on the basis of an output of said first detecting portion and an output of said second detecting portion.

Figure 4:
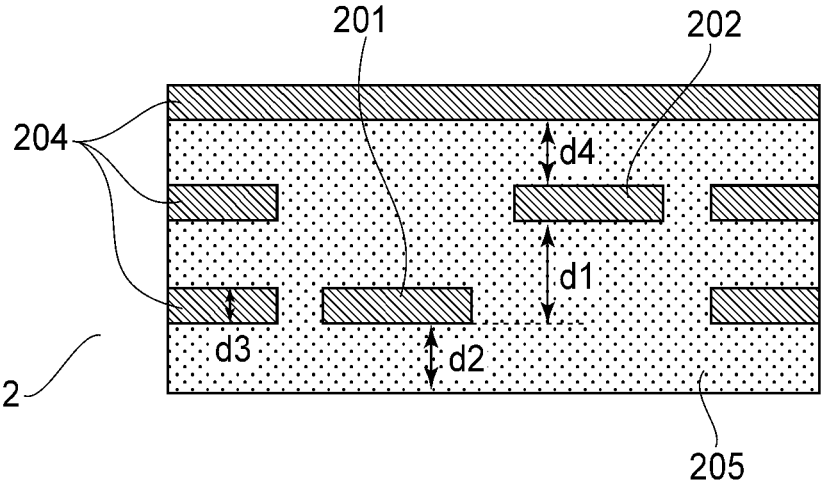
Figure 4:
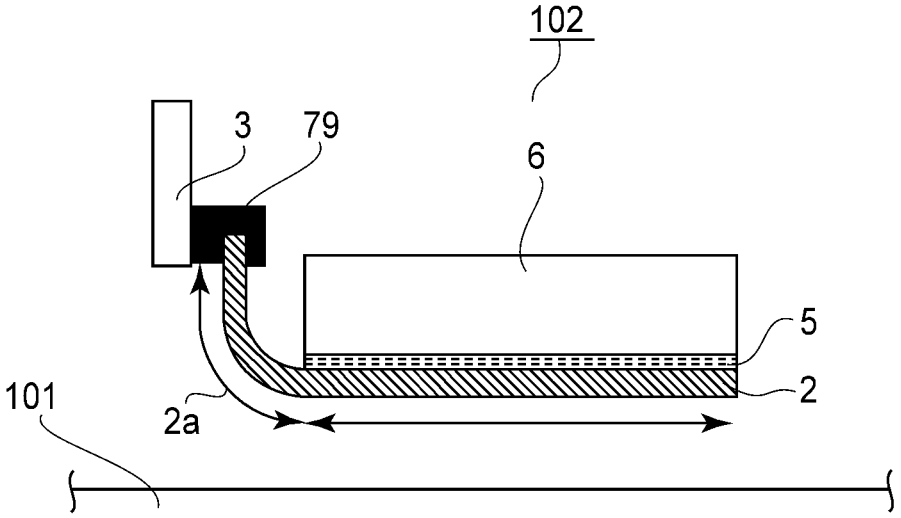

Part (a) of FIG. 4 is a sectional view of the potential sensor and part (b) of FIG. 4 is a sectional view of the potential sensor and a holding mechanism therefor.

Figure 5:
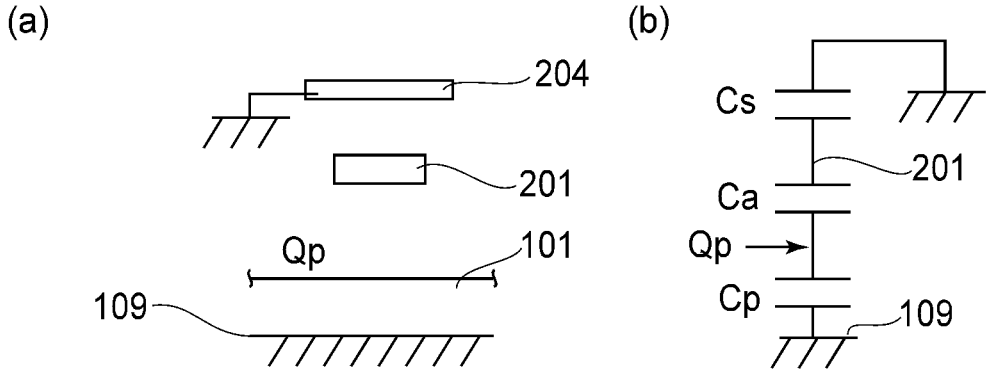

FIG. 5 shows an equivalent circuit of the potential sensor in the first embodiment.

Figure 6:
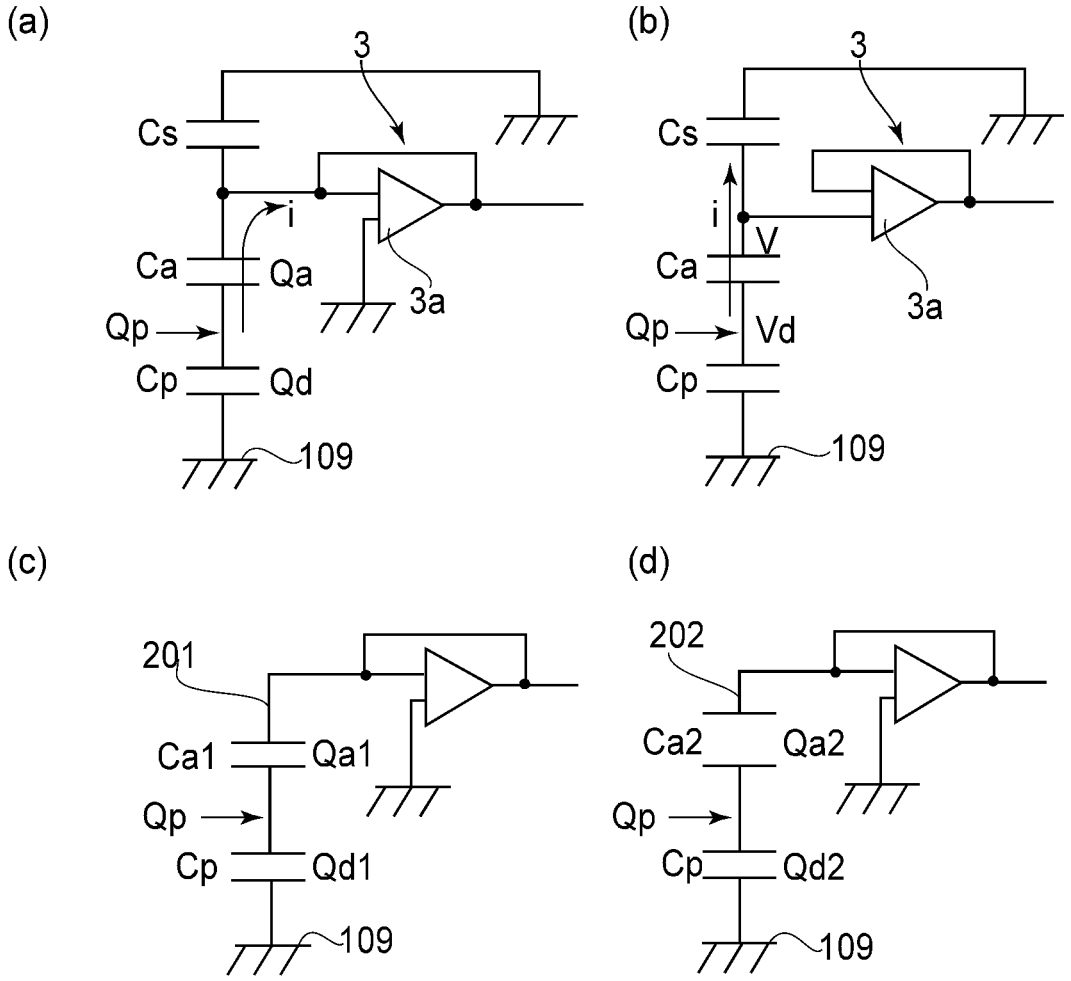

Parts (a) and (b) of FIG. 6 illustrate a current method and a potential method for detecting a signal from the potential sensor, and parts (c) and (d) illustrate the current method.

Figure 7:
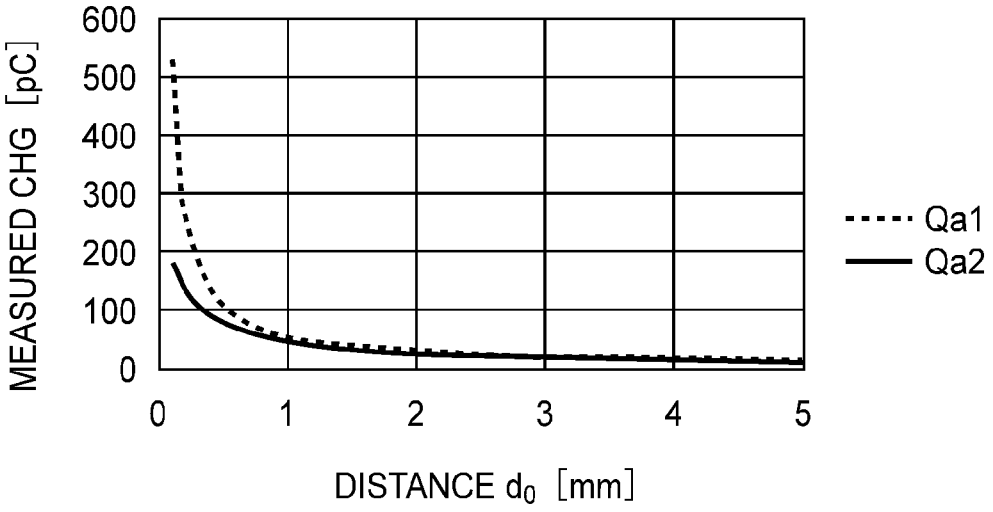
Figure 7:
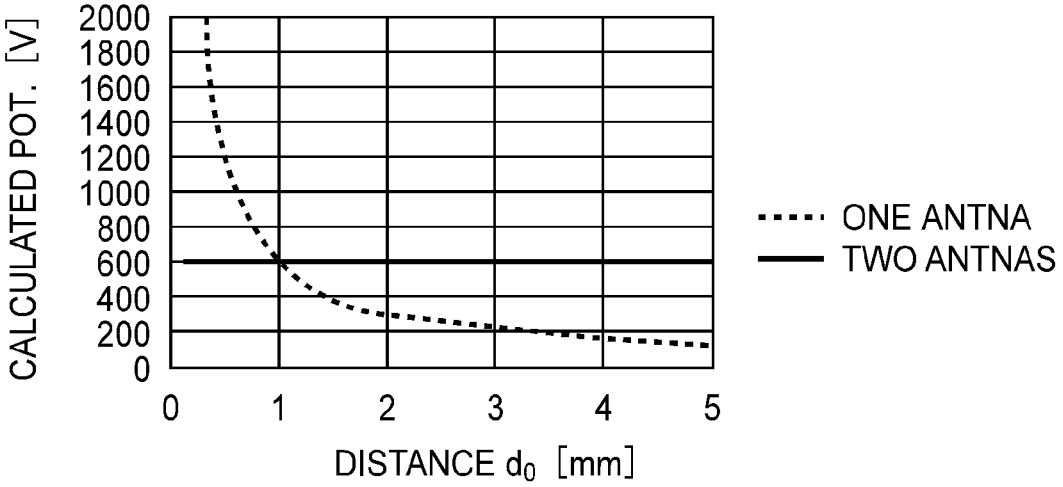

Part (a) of FIG. 7 illustrates relationship between an antenna measurement charge and a distance in the current method in the first embodiment, and part (b) illustrates a relationship between a calculation potential and the distance in the current method.

Figure 8:
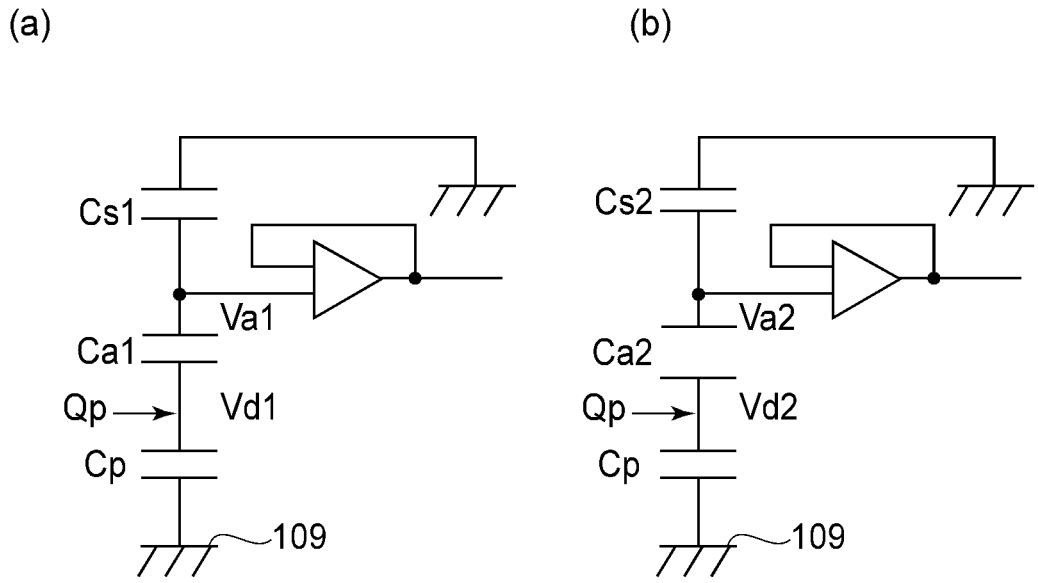

Parts (a) and (b) of FIG. 8 illustrates the potential method in the first embodiment.

Figure 9:
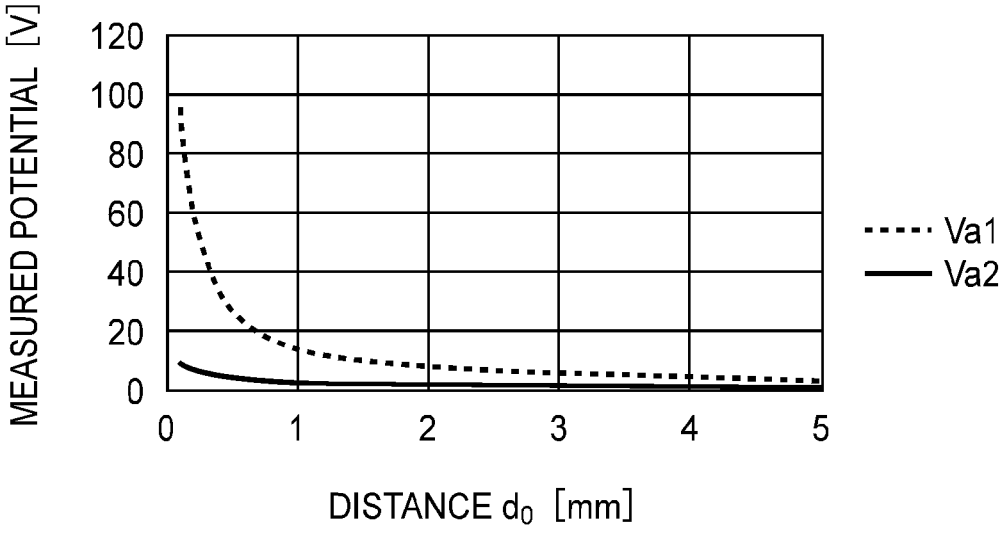
Figure 9:
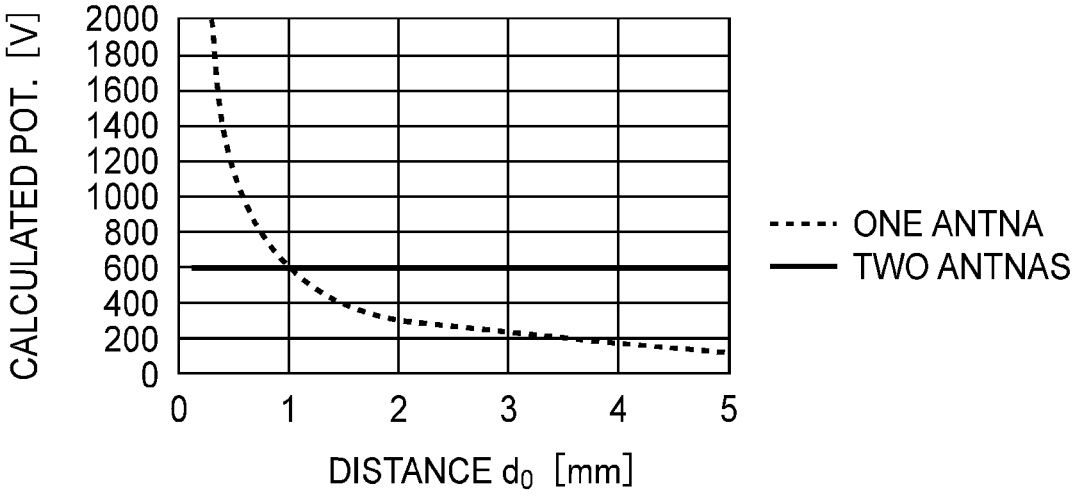

Part (a) of FIG. 9 illustrates a relationship between the antenna measurement potential and in the distance in the potential method in the first embodiment, and (b) illustrates a relationship between the calculation potential and the distance in the potential method.

Figure 10:
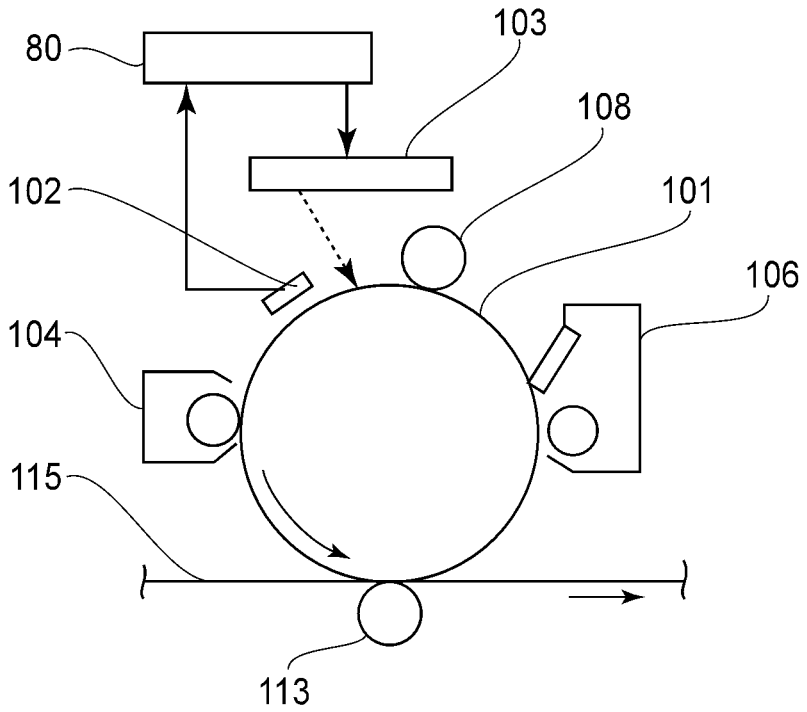

FIG. 10 illustrates an image forming station using a roller charging in the first embodiment.

Figure 11:
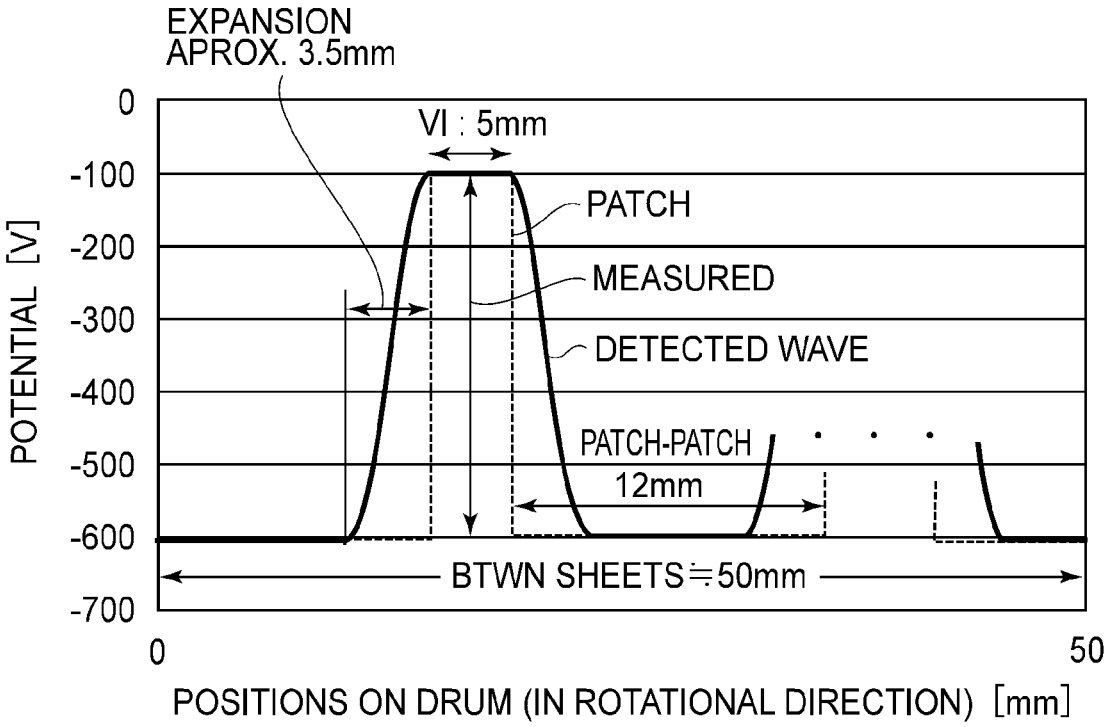

FIG. 11 illustrates a signal of the potential sensor in the image forming station using the roller charging.

Figure 12:
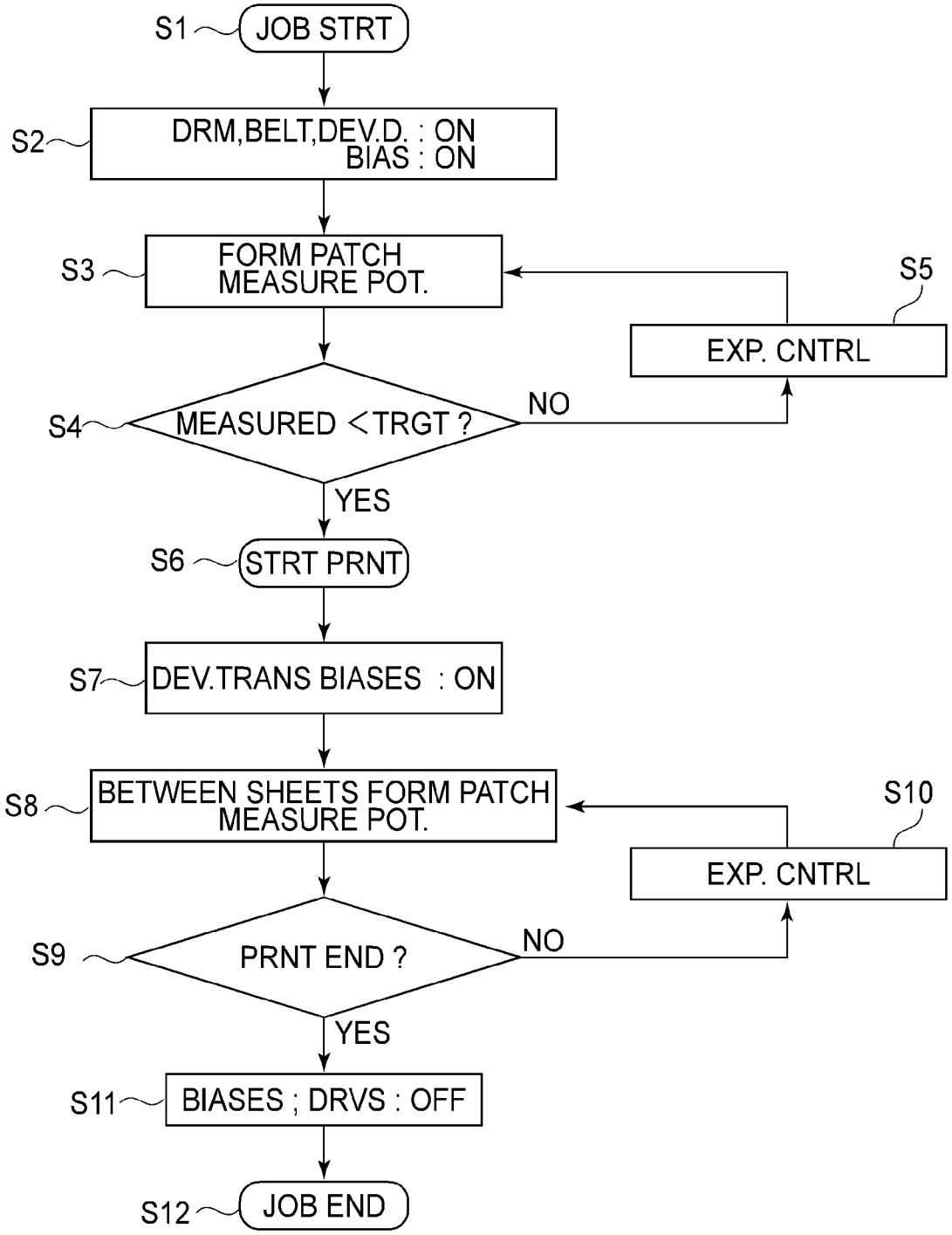

FIG. 12 is a flow chart showing the operation of the image forming station using the roller charging.

Figure 13:
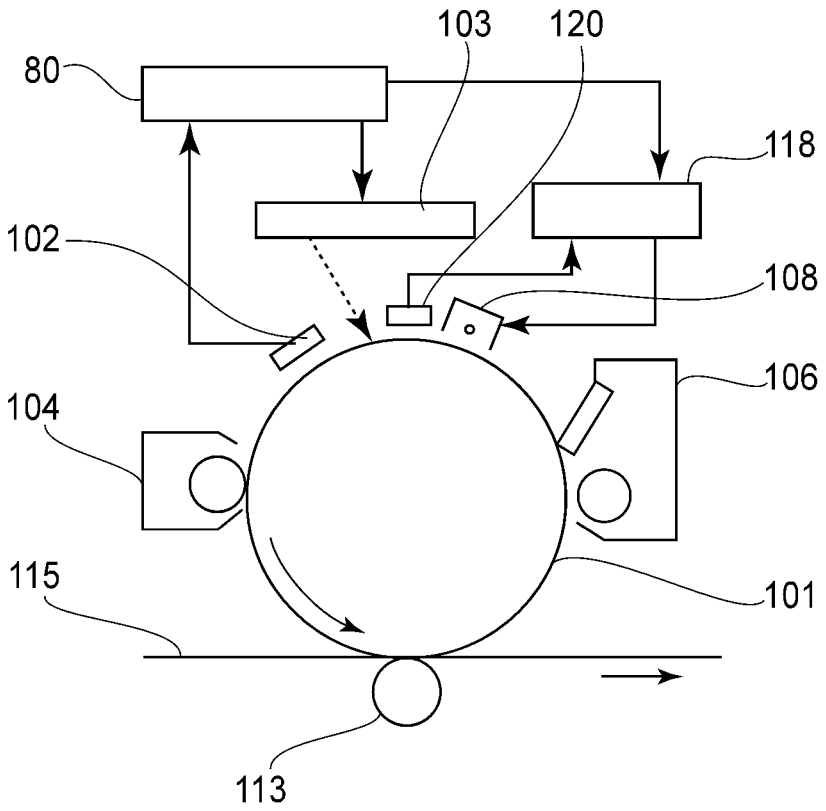

FIG. 13 illustrates the image forming station using corona charging.

Figure 14:
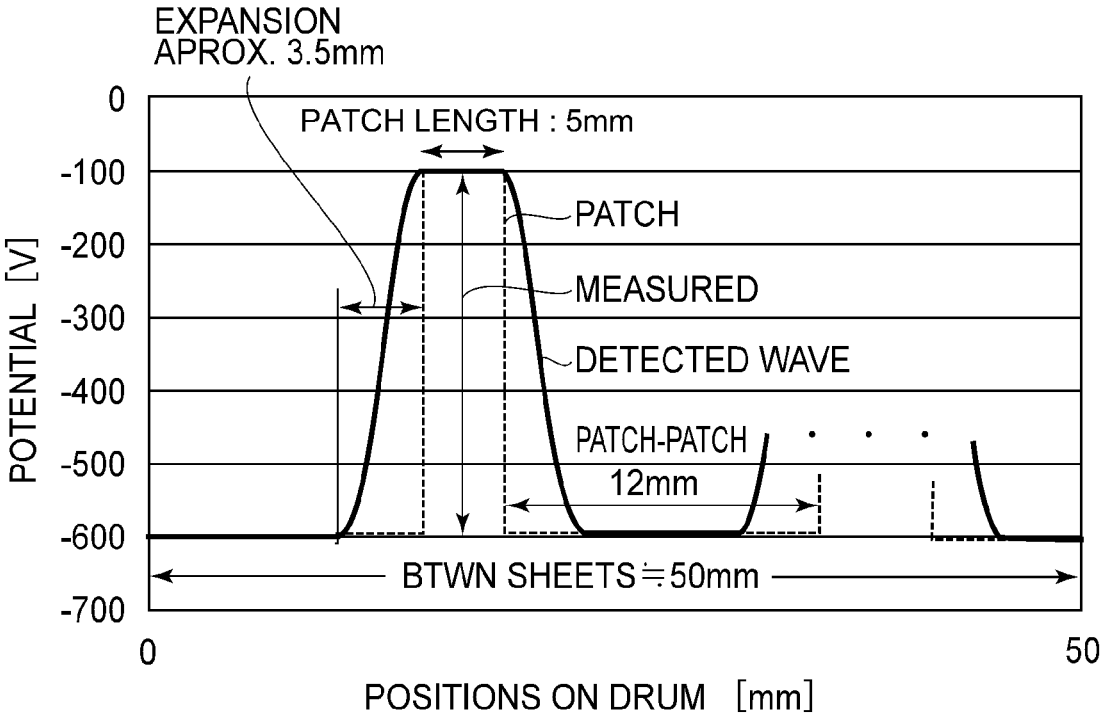

FIG. 14 illustrates the signal from the potential sensor in the image forming station using the corona charging.

Figure 15:
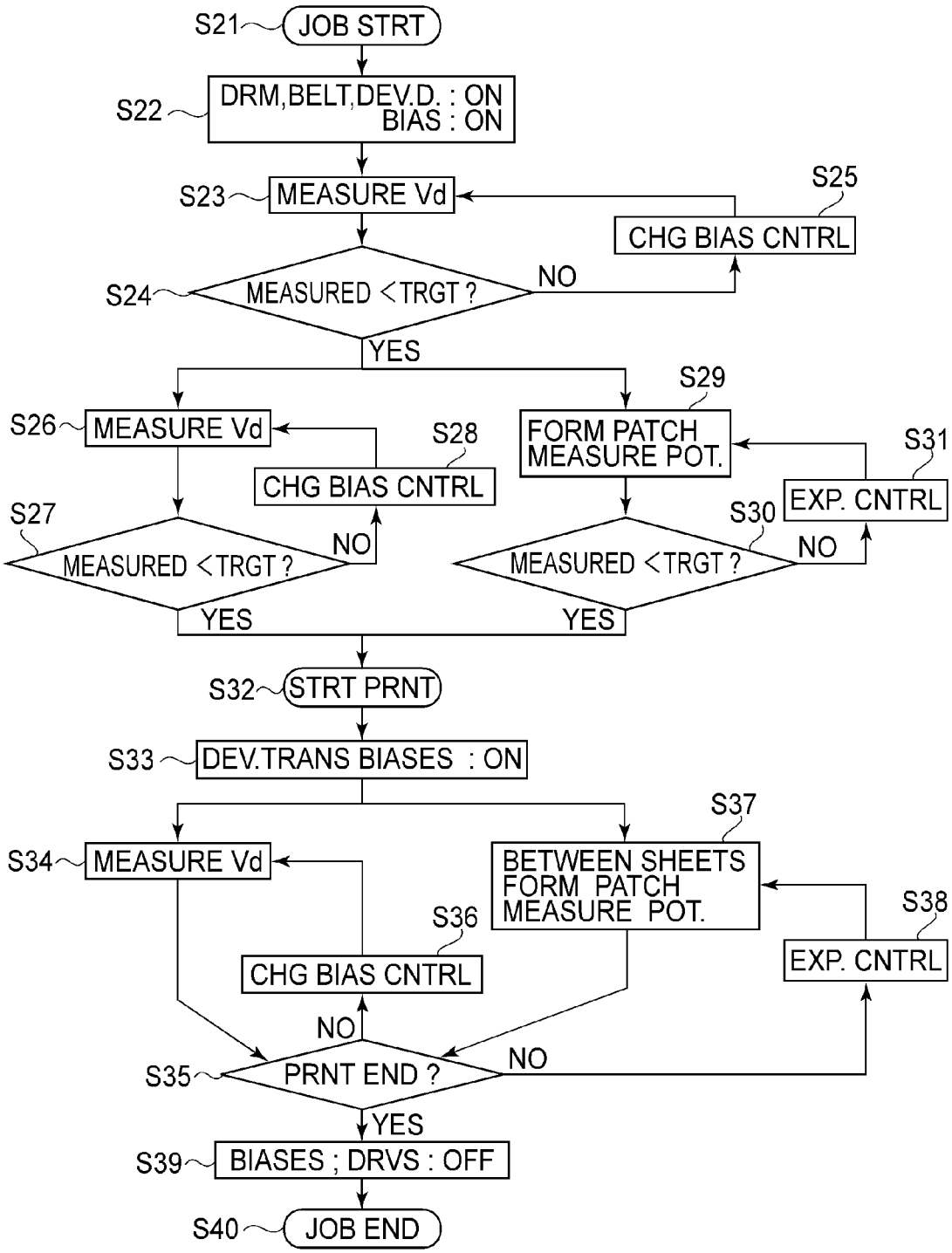

FIG. 15 is a flow chart showing the operation of the image forming station using the corona charging.

Figure 16:
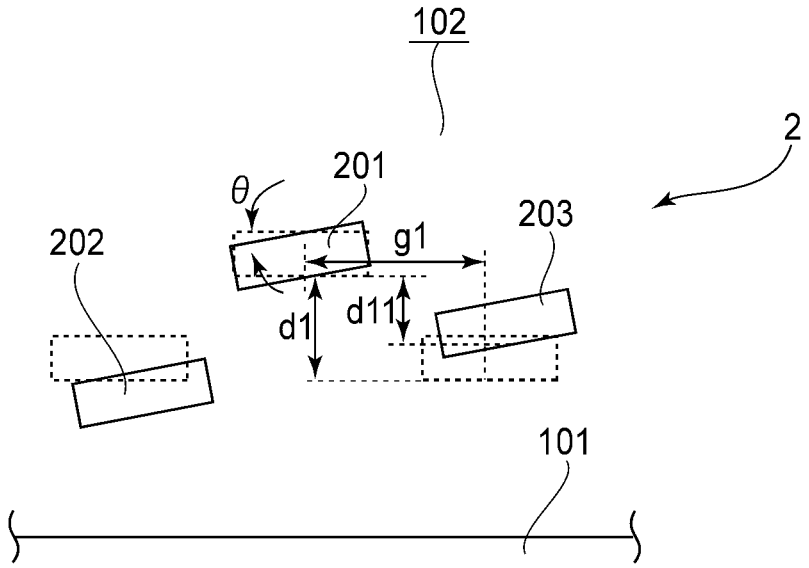
Figure 16:
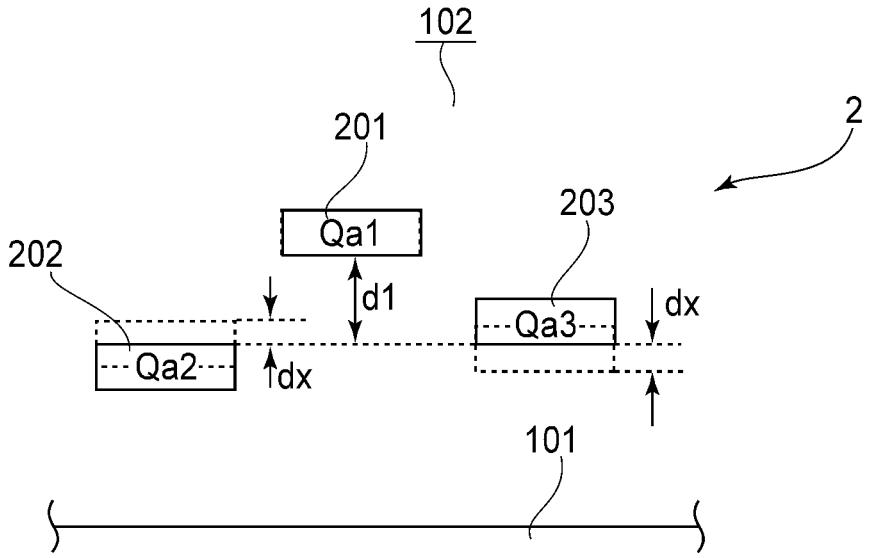

Part (a) of FIG. 16 is a schematic view illustrating the state in which the potential sensor is oblique in the first embodiment, and part (b) is a schematic view of a model approximating the inclination of the potential sensor.

Figure 17:
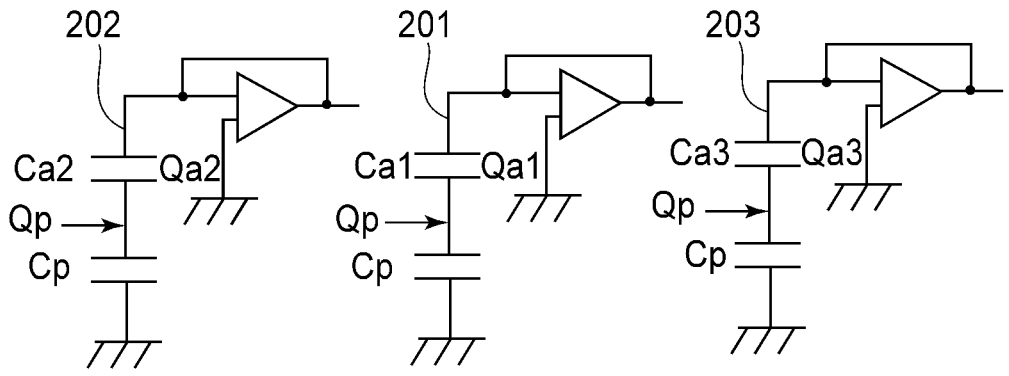

FIG. 17 illustrates the current method in a second embodiment.

Figure 18:
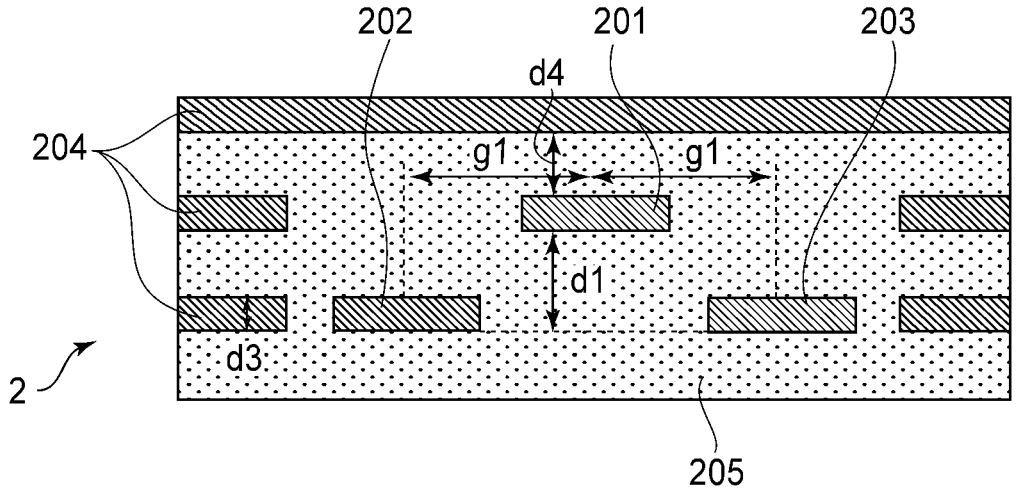

FIG. 18 is a sectional view illustrating a potential sensor in the second embodiment.

Figure 19:
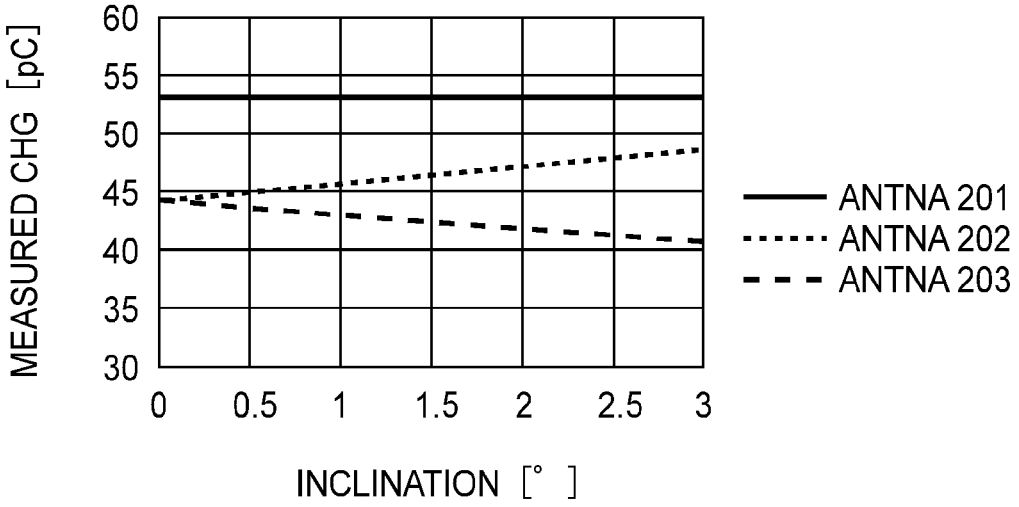
Figure 19:
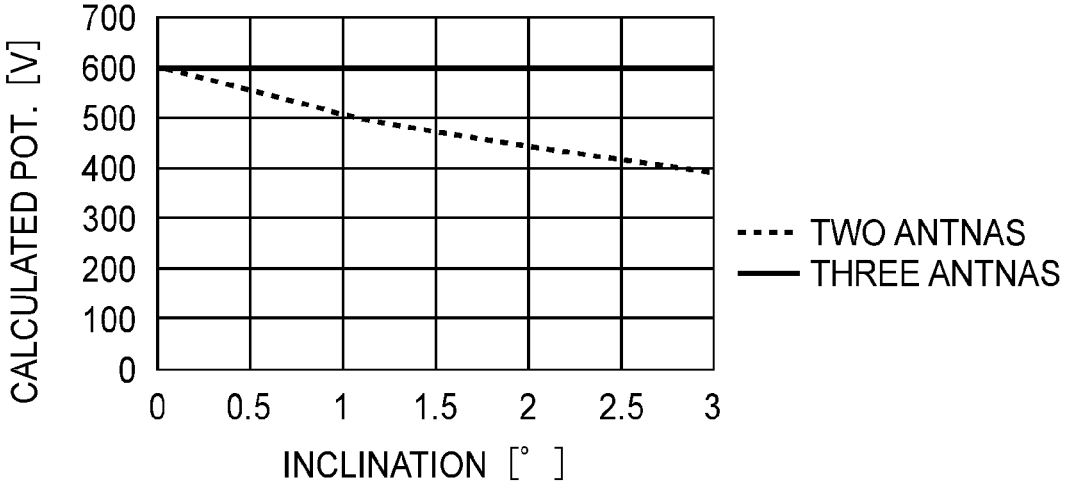

Part (a) of FIG. 19 illustrates a relationship between an antenna measurement charge and the inclination in the current method in the second embodiment, and part (b) illustrates a relationship between the calculation potential and the inclination in the current method.

Figure 20:
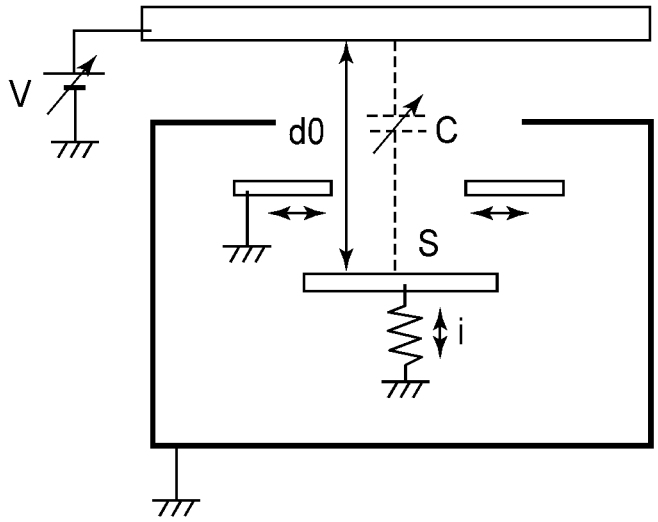
Figure 20:
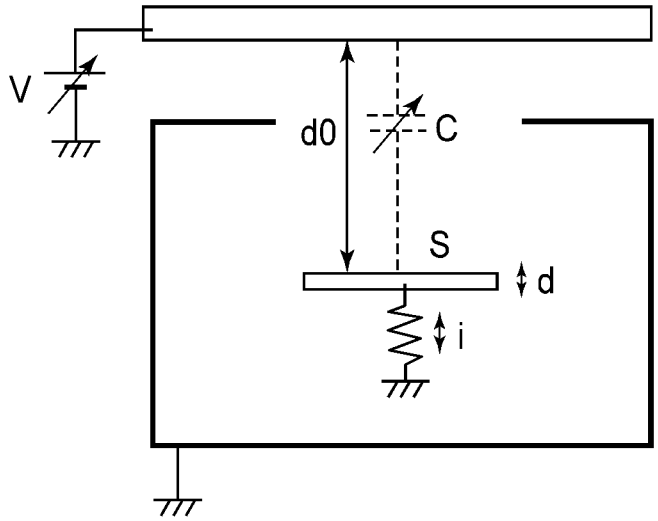

Part (a) of FIG. 20 illustrates a principle of a shutter type potential sensor, and part (b) illustrates a principle of the potential sensor of a probe vibration type.

DESCRIPTION OF THE PREFERRED EMBODIMENTS

Embodiment 1

Hereinafter, the first embodiment of the present invention is described with reference to appended drawings. To begin with, the device, this embodiment, for detecting the potential level of a photosensitive member will be generally described. Then, an image forming apparatus which employs the device for detecting the potential level of the photosensitive member is described. Then, details of detection of potential level of a photosensitive member is given (structure of device, and method for calculating potential level). Lastly, a system employed by an image forming apparatus, as an integral part of the apparatus, to detect the potential level of the photosensitive member of the apparatus is described.

Figure 1:
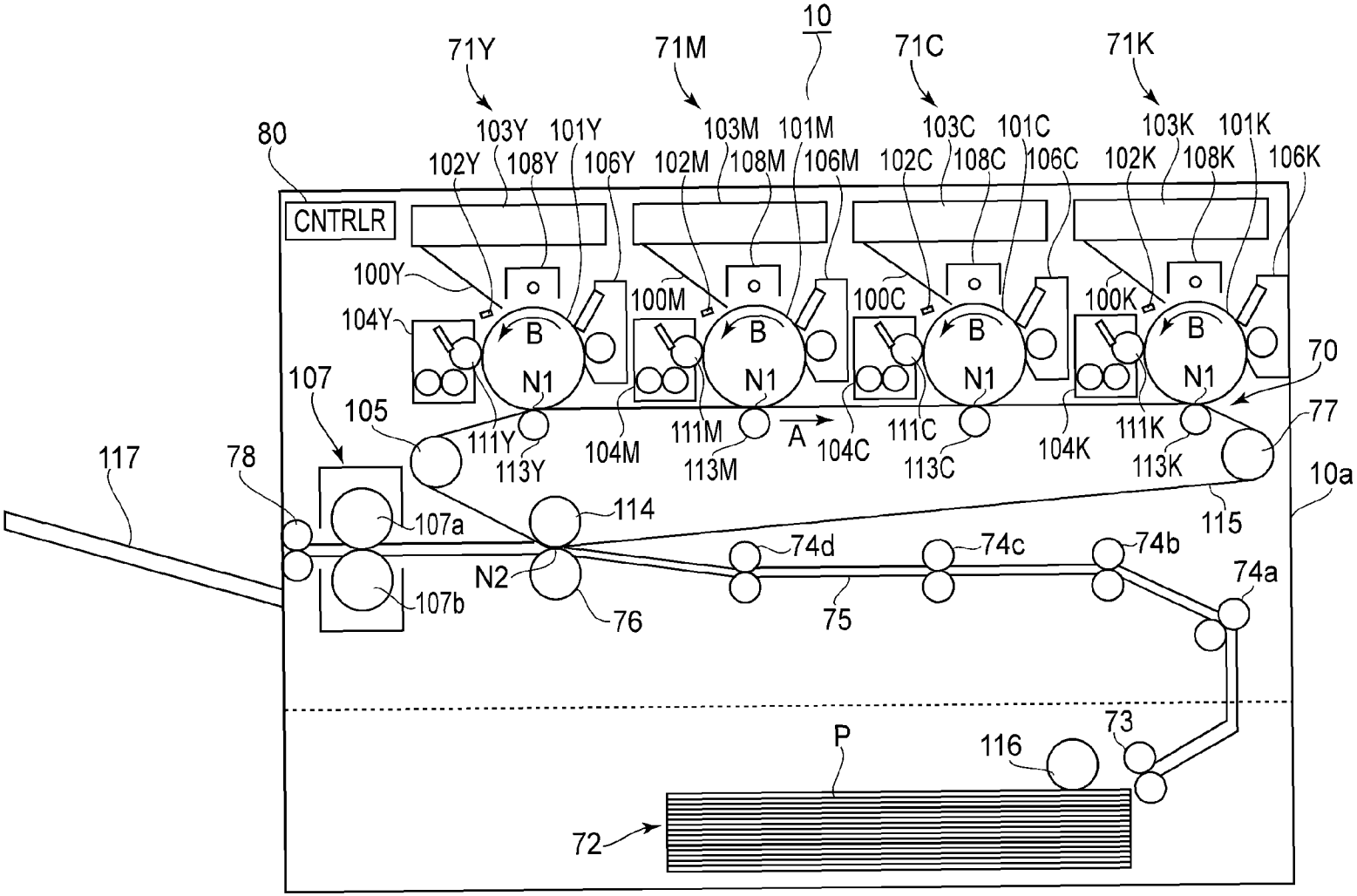
FIG. 1 is a schematic review illustrating a structure of an image forming apparatus according to a first embodiment of the present invention.
Figure 2:
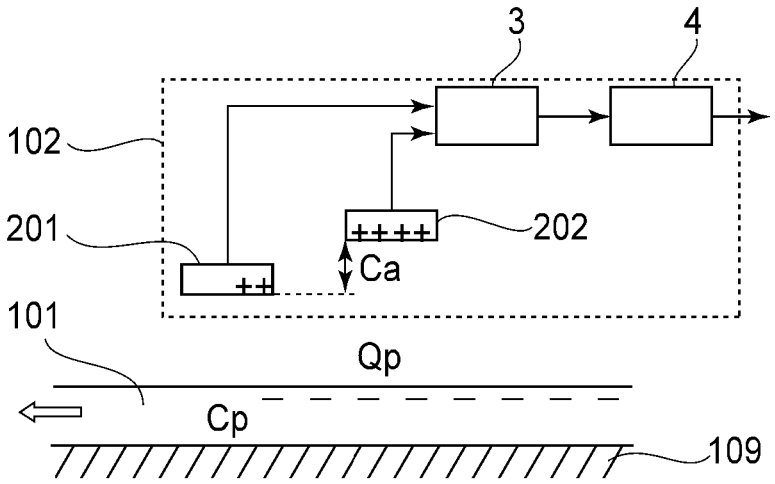
FIG. 2 is a schematic view of a circuit structure according to the first embodiment.

First, referring to FIG. 2, the detection of the potential level of a photosensitive member is described in term of general concept. The present invention is related to an electrical potential sensor which is capable of accurately measuring the surface potential level of a photosensitive member, regardless of the distance between a photosensitive member (which hereafter may be referred to as "photosensitive drum"), which is an object of the potential level measurement, and an antenna (electrode). One of the methods for detecting the potential level of a photosensitive drum is as follows. A pair of antennas 201 and 202 are positioned in the adjacencies of the peripheral surface of the photosensitive drum 101, and the signals from the antennas are detected by a detecting section (detecting device) 3. The two antennas 201 and 202 are different in the electrostatic capacity relative to the photosensitive drum 101. The detecting section 3 is in connection to a control section 80 (FIGS. 1, 10 and 13) through a computing section 4. The computing section 3 computes based on the output signals from the antennas 201 and 202 so that the variable attributable to the change in the distance between the antenna 201 and photosensitive drum 101 and the variable attributable to the change in the distance between the antenna 202 and photosensitive drum 101 cancel each other. In this embodiment, only one detecting portion 3 is provided for the two antennas. However, the potential level detecting device may be structured so that each antenna is provided with its own detecting section. In this embodiment, the two detecting sections may be sometimes referred to by two different names, one for one, for the sake of convenience. However, the function of the first detecting section and the function of the second detecting section may be integrated into one detecting section as they are in this embodiment.

In the case of a potential level detecting device shown in FIG. 2, the antennas 201 and 202 are made different in their distance from the photosensitive drum 101, in order to make the antennas 201 and 203 different in electrostatic capacity. The antennas 201 and 202 are fixed to a single component in such a manner that the amount of change in the distance of the antenna 201 from the photosensitive drum 101 becomes the same as the amount of change in the distance of the antenna 202 from the photosensitive drum 101, and also, that the change in the distance of the antenna 202 from the photosensitive drum 101 occurs a preset length of time after the occurrence of the change in the distance of the antenna 201 from the photosensitive drum 101. However, based on the relationship among C, ∈S, d (C=∈S/d), the means for detecting the potential level of the peripheral surface of the photosensitive drum 101 may be structured so that the antennas 201 and 202 become the same in their distance from the photosensitive drum 101, and one of the antennas is exposed to the photosensitive drum 101, whereas the other is covered with a dielectric member to make the two antennas different in dielectric constant.

With the device being structured as described above, it is possible to compute based on the detection signals from the antennas 201 and 202 in such a manner that variable common components attributable to the changes in the distance from the antennas 201 and 202 to the photosensitive drum 101 cancel each other. Thus, the value obtainable by the computation is dependent upon Ca which is the difference in electrostatic capacity between the antennas 201 and 202, and Cp which is the electrostatic capacity of the photosensitive drum 101. Here, the electrostatic capacity Ca and electrostatic capacity Cp are known. Thus, the surface potential level of the photosensitive drum 101 can be accurately computed based on the detection signals from the antennas 201 and 202, without being affected by their distance from the photosensitive drum 101.

Here, two points which are to be taken into consideration are described. The first is the effect of the changes in the electrostatic capacity Pp of the photosensitive drum 101. The electrostatic capacity Cp is known as described above. However, it sometimes changes. More concretely, in the case of an electrophotographic image forming apparatus, the peripheral surface of the photosensitive drum 101 is cleaned by a cleaning blade which is placed in contact with the peripheral surface of the photosensitive drum 101. Thus, the peripheral surface of the photosensitive drum 101 is likely to be gradually shaved away.

Thus, the electrostatic capacity Cp of the photosensitive drum 101 is affected by the length of time the image forming apparatus is used for image formation. However, this change in the electrostatic capacity Cp of the image forming apparatus is very slow. Therefore, the amount of this change can be obtained with the use of one of the following two methods.

(i) The change in the thickness of the photosensitive layer of a photosensitive drum can be predicted based on the thickness of photosensitive drum detected prior to the shipment of image forming apparatus (photosensitive drum) from a factory, cumulative length of usage of the image forming apparatus, change in the environment in which the image forming apparatus is in use, etc.

(ii) The thickness of a photosensitive drum can be obtained by measuring V-I characteristic of a charging roller (Japanese Laid-open Patent Application 2011-13431).

These methods (i) and (ii) have been in use in the field of an electrophotographic image forming apparatus, and have been used for controlling the length of the service life of a photosensitive drum. Thus, either of the two methods can be used to obtain the electrostatic capacity Cp of the photosensitive drum 101.

The second point relates to the measured data. More particularly, the potential level sensor 102 does not detect the value per se of the surface potential of the photosensitive drum 101, but detects a change (relative value) of the surface potential. The potential level sensor of the electrostatic capacity type causes an induced current in the antenna, and detects an induced current, on the basis of which the potential of the object (photosensitive drum) is calculated.

Here, in order to produce the induced current, the surface potential of the object (photosensitive drum) or the electrostatic capacity of the antenna is required to change, because Q=CV. The potential sensor 12 changes the surface potential of the photosensitive drum 11 to produce the induced current in the antennas 201 and 202.

That is, the potential difference between before and after the potential change is detected. In the image forming apparatus of the electrophotographic type, the photosensitive member is electrically charged and then exposed to image light by the charging device and the exposure device which constitute an image forming station, so that a potential distribution (electrostatic latent image) is provided on the surface of the photosensitive member. Using the potential level sensor 102 in such an image forming apparatus, the electrostatic latent image formed through the charging and image exposure steps is relatively moved right below the antenna, by which the plus and minus (relative value) of the potential of the electrostatic latent image is measured. In place thereof, the potential level sensor 102 may be moved relative to the electrostatic latent image on the photosensitive drum 101. In such a case, the similar effects also result. A method of conversion of the relative value of the potential to the absolute potential will be described with an exemplary electrophotographic system.

[Image Forming Apparatus]

An image forming apparatus 10 of this embodiment will be described.

FIG. 1 schematically illustrates the structures of the image forming apparatus 10 of this embodiment.

The image forming apparatus 10 shown in FIG. 1 comprises four image forming stations for forming four color images. Four color toner images are formed on the respective photosensitive drums 101 and are superimposedly transferred onto an intermediary transfer belt 115, thus forming a color image. In FIG. 1, the suffixes Y, M, C, K indicate the colors of the toner images, more particularly, Y indicates yellow, M indicates magenta, C indicates cyan and K indicates black.

As shown in FIG. 1, the image forming apparatus 10 comprises a main assembly 10*a*, and in the main assembly 10*a*, there is provided a controller 80 as controlling means, including a CPU, ROM and RAM, for controlling various parts of the apparatus. In the vertically central portion of the main assembly 10*a*, the intermediary transfer belt unit 70 including an intermediary transfer belt 115 as an intermediary transfer member is provided. Above the intermediary transfer belt unit 70 in the main assembly 10*a*, the image forming stations 71Y, 71M, 71C, 71K for the respective colors are disposed along the rotational moving direction of the intermediary transfer belt 115 (arrow A) in this order.

Below the intermediary transfer belt unit 70 in the main assembly 10*a*, there are provided a sheet feeding cassette 72 and a sheet feeding roller 116 for feeding the topmost recording material (sheet) P out of the recording materials accommodating in the sheet feeding cassette 72. The main assembly further comprises a pair of separation feeding rollers for feeding the recording material P fed from the sheet feeding roller 116 one by one, a feeding path 75 including pairs of feeding rollers 74*a*, 74*b*, 74*c* to feed the recording material P toward the downstream, and a pair of registration rollers 74*d*. Downstream of the feeding path 75, there is provided a fixing device 107 for fixing the toner image by heat and pressure in a fixing nip between a fixing roller 107*a* and pressing roller 107*b*, and a pair of sheet discharging rollers for discharging the recording material P onto a sheet discharge tray 117.

The intermediary transfer belt 115 is rotatably stretched along a driving roller 77, a tension roller 105 and an inner secondary-transfer roller 114 provided inside the intermediary transfer belt 115. Inside the intermediary transfer belt 115 at the positions opposing the respective photosensitive drums 101Y, 101M, 101C, 101K, the are provided primary transfer rollers 113Y, 113M, 113C, 113K to press contacted the intermediary transfer belt 115 to the respective photosensitive drums 101Y-101K. By the primary transfer rollers 113Y-113K press contacting the intermediary transfer belt 115 to the photosensitive drums 101Y-101K, primary transfer nips (primary transfer portion) N1 are formed between the photosensitive drums 101Y-101K and the intermediary transfer belt 115.

At the position opposing the inner secondary-transfer roller, there is provided an outer secondary-transfer roller. A secondary transfer nip (secondary transfer portion) N2 is formed by the inner secondary-transfer roller 114 and the outer secondary-transfer roller 76 press contacted to the inner secondary-transfer roller through the intermediary transfer belt 115. The secondary transfer nip N2 secondary-transfers the toner image from the intermediary transfer belt 115 onto the recording material P fed along the feeding path 75.

Around the photosensitive drum 101Y in the image forming station 71Y, there are provided along the rotational moving direction of the photosensitive drum 101Y (arrow B) a charging device 108Y, a laser scanner 103Y full projecting a laser beam onto the photosensitive drum 101Y. Furthermore, a potential sensor 102Y, a developing device 104Y including a developing sleeve 111Y, and a cleaning device 106Y are provided. The other image forming stations 71M, 71C, 71K have the structures similar to those of the image forming station 71Y, and therefore, the description thereof is omitted by the suffixes M, C and K. This will be applied to the other structure of parts. When the description refers to all of the corresponding structures for the respective colors, the suffixes are not added (photosensitive drum 101, for example) in the following descriptions.

The laser scanners 103 (103Y, 103M, 103C, 103K) which are the exposure devices functions as the image forming station for forming electrostatic images on the respective photosensitive drums 101 (101Y, 101M, 101C, 101K). The potential sensor 102 (102Y-102K) is opposed to the surface of the photosensitive drum 101 (101Y-101K) without contact thereto, and is a potential detecting device comprising first and second antennas which provide electrostatic capacities different from each other between the photosensitive drum 101. In this embodiment, an antenna 201 constitutes a first electrode, and an antenna 202 constitutes a second electrode.

The process of forming a toner image on the photosensitive drum and transferring the toner image onto the intermediary transfer belt superimposedly is common to the respective colors, and therefore, the following description will be made without referring to the colors. The same reference numerals are assigned to the elements having the corresponding functions.

[Operation of Image Forming Apparatus]

In the image forming apparatus 10, when a print start signal is produced, the surface of the photosensitive drum 101 is electrically charged to a predetermined potential by a charging device 108.

A laser beam 100 modulated in accordance with the image signal is applied onto the photosensitive drum 101 from the laser scanner 103, by which an electrostatic latent image is formed on the photosensitive drum 101.

In the developing device 104, a charge amount of toner particles in the accommodated developer is increased in the manner which will be described hereinafter, and then the toner particles are transferred onto the photosensitive drum by an electrostatic force caused by the electric field formed between the electrostatic latent image and the developing sleeve 111 to visualize the electrostatic latent image into a toner image on the photosensitive drum. The intermediary transfer belt 115 is nipped between the photosensitive drum 101 and the primary transfer roller 113 to form a primary transfer portion (N1).

The toner image formed on the photosensitive drum 101 is primary-transferred onto the intermediary transfer belt 115 by the primary transfer roller 113. The foregoing steps are repeated for the yellow, magenta, cyan and black colors, by which a four color toner image is formed on the intermediary transfer belt 115. The surface of the photosensitive drum 101 after the primary-transfer of the toner image, the residual toner or the like not transferred is removed by the cleaning device 106, so that the photosensitive drum 101 is used for the next image formation.

The recording material P accommodated in the sheet feeding cassette 72 is fed out one by one by the sheet feeding roller 116 and the separation feeding roller pair 73 to the registration roller pair 74*d* along the feeding path 75. The recording material P is fed into the secondary transfer nip (secondary transfer portion) N2 in timed relationship with the toner image carried on the intermediary transfer belt 115, by the registration roller pair 74*d*. By this, the toner image is secondary-transferred onto the recording material P from the intermediary transfer belt 115 in the secondary transfer nip N2, and is fixed by the heat and pressure in the fixing device 107. The recording material P now carrying the fixed image is discharged onto the sheet discharge tray 117 by the sheet discharging roller pair 78.

The foregoing is the description of the image print output of the image forming apparatus 10 of the tandem type color electrophotographic type using the intermediary transfer member type.

In this embodiment, the potential of sensor 12 is disposed between the laser beam 100 and the developing device 104. The potential level sensor 102 detects the plus and minus of the potential of the electrostatic latent image, and then using the result of the detection, the light intensity of the laser beam 100 and/or the charging of the charging device 108 is controlled.

[Structure of Potential Level Sensor]

Figure 3:
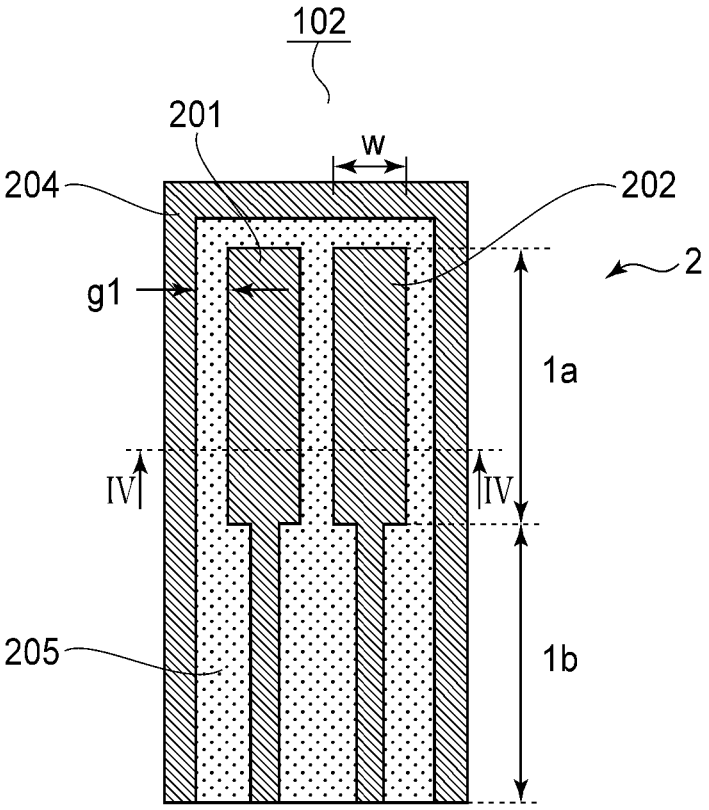
FIG. 3 is a top plan view of a potential sensor in the first embodiment.

Next, referring to FIGS. 3, 4(part (a)) and 4(part (b)), the structure of the potential level sensor 102 in this embodiment is described. By the way, FIG. 3 is a front view of the sensor head portion 2 of the potential level sensor 102, and FIG. 4(part (a)) is a sectional view of the sensor head portion 2, at a plane indicated by a line IV-IV in FIG. 3. FIG. 4(part (b)) is a side view of the potential level sensor 102 held by its sensor head portion 2.

Referring to FIG. 3, the sensor head portion 2 of the potential level sensor 102 has: antennas 201 and 202, guard electrodes 204, an edge portion 205, a leader line 2*a* (FIG. 4(part (b))) through which the signals from the antennas 201 and 202 are outputted.

Also referring to FIG. 3, the potential level sensor 102 in this embodiment is 1 [mm] in antenna width w, 10 [mm] in antenna length la, and 30 [mm] in the length of the leader line lh, for example. In order to ensure that the measurements of the potential level sensors 102 meet the above-mentioned specifications when the potential level sensor 102 is manufactured, a flexible plate (flexible polyamide plate) which is widely used for internal wiring of electrical ware was used as the substrate for the potential level sensor 102. Regarding this flexible substrate, an electrode layer can be formed on a piece of base film which is 25 [μm] in thickness, and then, an electrode pattern can be formed thereon by wet etching. Further, a multilayer electrode pattern can be easily formed by layering the thus formed pieces of film having an electrode pattern.

Referring to FIG. 4(part (a)), in order to make the antennas 201 and 202 different from each other in electrostatic capacity relative to the photosensitive drum 101, the sensor head portion 2 is formed of three flexible substrates layered so that the antennas 201 and 202 become different from each other in terms of their distance from the photosensitive drum 101. More concretely, the distance d1 between the antenna 201 and 202 was made to be 200 [μm]. Further in order to prevent electromagnetic noises from entering the antennas 201 and 202, the sensor head portion 2 is structured so that guard electrodes 204, which are grounded, are present in the adjacencies of the antennas 201 and 203, except for the side on which the photosensitive drum 101 is present.

Regarding the measurement of the other portions of the sensor head portion 2, the surface dielectric layer of the insulating portion 205 was made to be 15 [μm] in thickness, and each of the antennas 201 and 202, and guard electrodes 204 was made to be 15 [μm] in thickness. Further, the sensor head portion 2 was manufactured so that the distance d4 between the back surface (top side in drawing) and the rear guard electrode 204 became 15 [μm]. The insulating portion 205 is formed of polyamide, and is roughly 3 in its dielectric constant E. By the way, referring to FIG. 4(part (a)), in order to make the antennas 201 and 202 different in the amount of electrostatic capacity, the distance of the antenna 201 from the photosensitive drum 101 was made different from the distance of the antenna 202 from the photosensitive drum 101 by a distance d1. Instead, however, the structure may be modified so that the dielectric constant can be changed based on the relationship (C=∈S/d).

Next, referring to FIG. 4(part (b)), the sensor head portion 2 held to the detecting section 3 with the placement of the supporting member 79 between the lead line 2*a* and detecting section 3, outputs the signals detected by the antennas 201 and 202 to the detecting section 3 through the leader line 2*a*. The detecting section 3 is in connection to the control section 80 (FIG. 1) through a computing section 4 (FIG. 2), and sends the detection signals inputted from the antennas 201 and 202, to the computing section 4, which sends the results of its computation to the control section 80. Further, in order to ensure that the antennas 201 and 202 remain properly facing the photosensitive drum 101, the antenna portion of the sensor head portion 2, which is made up of the antennas 201 and 202, guard electrodes 204, and insulating portion 205, is fixed to the supporting block 6, with a coated adhesive layer 5, by its back surface.

As described above, the potential level sensor 102, which is a detecting device, has the detecting section 3 and computing section 4. As an electrostatic latent image (electrostatic image) is moved relative to the potential level sensor 102, electric current is induced in the antennas 201 and 202, which are the first and second electrodes, respectively. The detecting section 3, which is a detecting circuit, detects these electric currents induced in the antennas 201 and 202. Incidentally, the structure may be such that the potential level sensor 102 is moved relative to the electrostatic latent image on the photosensitive drum 101, to obtain the same effects as those obtainable by this embodiment. This applies to each of the following examples of embodiments (inclusive of second embodiment).

As the electrostatic latent image formed on the photosensitive drum 101 is moved, the computing section 4 computes, based on the electrical signals outputted from the antennas 201 and 202, so that the changes in the amount of electrostatic capacity between the antenna 201 and photosensitive drum 101, and the changes in the amount of electrostatic capacity between the antenna 202 and photosensitive drum 101 (amount of change in distance between antenna 201 and photosensitive drum 101) cancel each other. Then, the computing section 4 calculates the potential level of the electrostatic image formed on the peripheral surface of the photosensitive drum 101 (image bearing member). This computing section 4 calculates the potential level of the electrostatic image based on the electrical signals outputted from the detecting section 3 (detection circuit).

The control section 80 controls the laser scanners 103 (103Y, 103M, 103C and 103K) in the following manner, not only in this embodiment, but also in the second embodiment which will be described later. That is, the control section 80 controls the laser scanners 103 (103Y-103K) based on the potential level of the electrostatic latent image formed on the peripheral surface of the photosensitive drum 101, which is obtained from the potential level sensors 102 (102Y-102K).

The supporting block 6 is fixed to the casing, for example, of the image forming apparatus 10. The photosensitive drum 101 of the image forming apparatus 10 is eccentric by several tens of micrometer per rotational period. Therefore, in the case where the method shown in FIG. 4(part (b)) is used to fix the supporting block 6 to the casing of the image forming apparatus 10, it is possible that as the photosensitive drum 101 rotates, the distance between the antenna 201 and the photosensitive drum 101, and the distance between the antenna 202 and photosensitive drum 101, will change by several tens of micrometer. Moreover, it is possible that when the sensor head portion 2 is attached, its position, in terms of the vertical direction, might have deviated by roughly 0.5 [mm] due to the tolerance afforded for the manufacturing of the casing and supporting block 6, and the errors which occurred during the attachment of the sensor head portion 2.

This embodiment can accurately measure the surface potential level of the photosensitive drum 101, by eliminating the effect of the deviations, which are attributable to the above-described eccentricity and attachment errors. Therefore, this embodiment does not require highly accurate positional control and adjustment, and a high voltage power source (zero method). Thus, this embodiment makes it possible to inexpensively manufacture the potential level sensor 102.

Given in the foregoing is the description of the structure of the potential level sensor 102. Next, referring to FIGS. 5(part (a)) and 5(part (b)), and FIGS. 6(part (a)) and 6(part (b)), the computing method for eliminating the effects of the changes in the distance between the antenna 201 and photosensitive drum 101, and the distance between the antenna 202 and photosensitive drum 101. By the way, FIGS. 5(part (a)) and 5(part (b)), and FIGS. 6(part (a)) and 6(part (b)) are drawing for describing the method for detecting the antenna signals.

[Computing Method Based on Signals from Potential Level Sensor]

Here, the method for accurately measuring the surface potential level of the photosensitive drum 101 by eliminating the effects of the changes in the distance between the antennas 201 and photosensitive drum 101, and the distance between the antenna 202 and photosensitive drum 101, by detecting the signals from the two antennas 201 and 203 which are different in the amount of electrostatic capacity relative to the photosensitive drum 101, is described. Here, the method for detecting the signals from the two antennas 201 and 202, and the computing method are described.

Hereafter, in order to describe the detecting method and computing method, the equivalent circuits shown in FIGS. 5(part (a)) and 5(part (b)) are used. To begin with, referring to FIG. 5(part (a)), the circuit made up of the ground electrode 109, photosensitive drum 101, antenna 201 and guard electrode 204 can be expressed in the form of an equivalent circuit, shown in FIG. 5(part (b)), which is a circuit made up of three electrostatic capacities Cp, Ca and Cs which are in serial connection.

Here, Cp stands for the electrostatic capacity of the photosensitive drum 101, that is, the electrostatic capacity between the ground electrode 109 and photosensitive drum 101, at the peripheral surface of the photosensitive drum 101. Ca stands for the amount of difference between the antenna 201 and 202 in terms of their electrostatic capacity relative to the photosensitive drum 101. Cs stands for the electrostatic capacity between the antenna 201 and guard electrode 204. As an electrostatic latent image is formed on the photosensitive drum 101, the surface charge Qp of the photosensitive drum 101 is injected between the electrostatic capacity Cp of the photosensitive drum 101 and the difference Ca between the antennas 201 and 202 in terms of their electrostatic capacity relative to the photosensitive drum 101.

Next, referring to FIGS. 6(part (a)) and 6(part (b)) which show the two methods for measuring the signals from the antennas 201 and 202, there are two methods for measuring the antenna signals. One of the two method makes the impedance of the detecting section 3 (detection circuit) small enough, relative to the impedance of that attributable to the electrostatic capacity Cs, to positively induce electrical current in the detecting section 3 (detection circuit), and detects the amount of the induced current (which hereafter will be referred to as "current-based method"). The other method makes the impedance of the detecting section 3 (detection circuit) large enough, relative to the electrostatic capacity Cs, to prevent electric current from being induced in the detecting section 3 (detection circuit), and measures the change in the potential level of the antenna (which hereafter will be referred to as "potential-based method").

In the case of the current-based method shown in FIG. 6(part (a)), the amount of induced electric charge Ca can be obtained by integrating the induced current in the circuit. That is, the surface charge Qp of the photosensitive drum 101 can be calculated from the amount of the Ca and Cp. Further, the surface potential level Vp of the photosensitive drum 101 can be calculated based on the relationship among Vp, Qp and Ca (Vp=Qp/Ca).

On the other hand, the potential-based method shown in FIG. 6(part (b)) can measure the changes in the potential level of the antennas. Thus, the amount of surface charge of the photosensitive drum 101 can be calculated from the amount of Cs, Ca and Cp. Also in the potential-based method, the surface potential level Vp of the photosensitive drum 101 can be calculated based on the relationship among Vp, Qp and Ca (Vp=Qp/Ca). Referring to FIGS. 6(part (a)) and 6(part (b)), the detecting section 3 has an operational amplifier 3*a*. This is true with the detecting section 3 shown in other drawings.

Both the current-based method and potential-based method measure the amount of difference in electrical charge and potential level of the photosensitive drum 101 between before and after electric current is induced in the antennas 201 and 202. That is, they cannot measure the absolute value of the surface charge Qa of the photosensitive drum 101. However, it is possible to use the system of the image forming apparatus 10 to calculate the absolute value of the surface potential level of the photosensitive drum 101. This method will be described at the end of the description of this embodiment.

Hereinafter, the current-based method and potential-based method are described in more detail.

[Current-Based Method]

First, referring to FIGS. 6(part (c)) and 6(part (d)), and FIGS. 7(part (a)) and 7(part (b)), the current-based method for processing the antenna signals from two antennas, and its effects, are described. FIG. 6(part (c)) is an equivalent circuit of the antenna 201, and FIG. 6(part (c)) is an equivalent circuit of the antenna 202. Referring to FIG. 6(part (d)), the antennas 201 and 202 are positioned adjacent to each other. Therefore, they are the same in terms of electrostatic capacity Cp and surface charge Qp of the photosensitive drum 101. Further, no current flows between the antenna 201 and guard electrode 204, and between the antennas 202 and guard electrode 204. Thus, the electrostatic capacity Cs between the antenna 201 and guard electrode 204, and the electrostatic capacity Cs between the antenna 202 and guard electrode 204 do not affect the circuit calculation, and therefore, are not shown in FIGS. 6(part (c)) and 6(part (d)).

Next, how the surface charge Qp of the photosensitive drum 101 can be calculated without involving the electrostatic capacity Ca1 between the peripheral surface of the photosensitive drum 101 and antenna 201, and the electrostatic capacity Ca2 between the peripheral surface of the photosensitive drum 101 and antenna 202, is described. By the way, Qd1 and Qd2 in FIGS. 6(part (c)) and 6(part (d)) are induction charges attributable to the electrostatic capacity Cp of the photosensitive drum 101.

In the case of the current-based method, the antennas 201 and 202 are fixed in potential level. Here, they are assumed to be 0 V in potential level. In this case, there is the following relationship (mathematical formula 4) between the induction charge Qa1 of the antenna 201 and the surface charge Qp of the photosensitive drum 101.

$$\frac{Q_{a1}}{C_{a1}} = \frac{Q_{d1}}{C_p} = \frac{Q_p - Q_{a1}}{C_p} \tag{4}$$

There is also the following relationship (mathematical formula (5)) between the induction charge Qa2 of the antenna 202 and the surface charge Qp of the photosensitive drum 101.

$$\frac{Q_{a2}}{C_{a2}} = \frac{Q_p - Q_{a2}}{C_p} \tag{5}$$

Here, the difference between the electrostatic capacity Ca1 between the antenna 201 and the peripheral surface of the photosensitive drum 101 and the electrostatic capacity Ca2 between the antenna 202 and the peripheral surface of the photosensitive drum 101 is defined as Ca. Then, Ca can be expressed in the form of the following mathematical formula (6).

$$\frac{1}{C_{a1}} - \frac{1}{C_{a2}} = \frac{1}{C_a} \tag{6}$$

Referring to FIG. 4(part (a)), the antennas 201 and 202 are fixed in position by the same dielectric portion 205. Thus, Ca is fixed in value. As electrostatic capacities Ca1 and Ca2 related to the antennas 201 and 202 are eliminated from the mathematical formulas (4)-(6), and the remaining terms are rearranged with regard to Qp, the following mathematical formula (7) is obtained.

$$Q_p = \frac{Q_{a1}Q_{a2}}{Q_{a2} - Q_{a1}} \cdot \frac{C_p}{C_a} \tag{7}$$

In mathematical formula (7), the induction charge Qa1 and Qa2 related to the antennas 201 and 202 are measurable, and so is the electrostatic capacity Cp of the photosensitive drum 101. Further, the difference Ca between the electrostatic capacities Ca1 and Ca2 related to the antennas 201 and 202, respectively, is fixed in value. All that is necessary is to measure Ca when the image forming apparatus 10 is shipped out of a factory. Further, as described above, Cp can be known by:

(i) measuring the film thickness when the image forming apparatus 10 is shipped out of a factory, and predicting the change in the film thickness attributable to length of usage, change in the environment in which the image forming apparatus 10 is used, etc, or (ii) measuring the V-I characteristic of the charging roller (Japanese Laid-open Patent Application 2011-13431).

Thus, by employing two antennas 201 and 202, it is possible to calculate the surface charge Qp of the photosensitive drum 101, without involving the distance between each antenna and photosensitive drum 101 (that is, electrostatic capacities Ca1 and Ca2 related to antennas 201 and 202). Further, it is possible to calculate the surface potential level Vp of the photosensitive member from the relationship among Vp, Qp and Cp (Vp=Qp/Cp).

Shown in FIG. 7(part (a)) are the amounts of the electric charges Qa1 and Qa2 of the antennas 201 and 202, respectively, which were measured by the current-based method. By the way, the distance between the antenna 202 and photosensitive drum 101 is greater by 200 [μm], for example, than that between the antenna 201 and photosensitive drum 101. The horizontal axis stands for the distance between the antenna and photosensitive drum 101. A distance d0 is the distance between the antenna 202 and photosensitive drum 101. The surface potential level of the photosensitive drum 101 is 600 [V]. It is evident from FIG. 7(part (b)) that the greater the distance d0, the smaller the measured amount of charge [Cp].

Further, FIG. 7(part (b)) shows the surface potential level of the photosensitive drum 101 calculated from the measured amount of charge (Cp). In the case of the current-based method in this embodiment, which employs two antennas 201 and 202 (two antenna system), the surface potential level of the photosensitive drum 101 was calculated with the use of mathematical formula (7). In the case of the current-based method which employs a single antenna (one antenna system), a coefficient is set so that when the distance d0 is 1 [mm], the surface potential level of the photosensitive drum 101 becomes 600 [V].

It is evident from FIG. 7(part (b)) that the greater the distance d0, the smaller the potential level of the photosensitive drum 101 calculated based on the signals from one antenna. It is evident from the examination of the calculated potential levels of the photosensitive drum 101 where the set value is in the adjacencies of 1 [mm], that even if the positioning is in error by only ±0.5 [mm], the calculated potential level [V] will be in error by several hundreds of V. In comparison, in the case of the potential level of the photosensitive drum 101 calculated from the signals from two antennas, the potential level of the photosensitive drum 101 is 600 [V] regardless of the distance d0.

As described above, the computing section 4 computes based on the electrical outputs (electric currents) which are induced in the antennas 201 and 202 as the electrostatic latent image formed on the photosensitive drum 101 of the photosensitive drum 101 is moved, in such a manner that the variable component in the electrostatic capacity between the antenna 201 and photosensitive drum 101, and the variable component in the electrostatic capacity between the antenna 202 and photosensitive drum 101 cancel each other. Further, the computing section 4 calculates the potential level of the electrostatic latent image formed on the photosensitive drum 101. That is, the computing section 4 calculates the potential level of the electrostatic image, based on the electrical outputs (electric currents) detected by the detecting section 3 and outputted by the detecting section 3. That is, the potential level sensor 102 is simpler in structure than any of conventional sensors.

In this embodiment described above, the computing section 4 can perform the following calculations with the use of the current-based method, when the electrical charges of the antennas 201 and 202, respectively, detected as electrical outputs are Qa1 and Qa2; the electrostatic capacity between the antenna 201 and photosensitive drum 101, and the electrostatic capacity between the antenna 202 and photosensitive drum 101 are both Ca; and electrostatic capacity of the photosensitive drum 101 is Cp. That is, the computing section 4 calculates the surface potential level Qp of the photosensitive drum 101, which induces the induction charges Qa1 and Qa2, with the use of the abovementioned mathematical formula (7). Then, it calculates the potential level of the electrostatic latent image, based on the surface potential level Vp of the photosensitive drum 101, which is calculated with the use of the relationship among Vp, Qp and Cp (Vp=Qp/Cp).

As described above, in the case of the current-based method, the surface potential level of the photosensitive drum 101 can be accurately calculated with the use of mathematical formula (7), regardless of the distance between the antenna 201 and photosensitive drum 101, and the distance between the antenna 202 and photosensitive drum 101.

[Potential-Based Method]

Next, referring to FIGS. 8(part (a)) and 8(part (b)), the potential-based method for processing the antenna signals from the two antennas, and its effects, are described. By the way, FIG. 8(part (a)) is an equivalent circuit of the antenna 201, and FIG. 8(part (b)) is an equivalent circuit of the antenna 202. Also in the potential-based method, the antennas 201 and 202 are positioned in the adjacencies of each other. The electrostatic capacity Cp and surface electric charge Qp of the photosensitive drum 101 in FIG. 8(part (a)) are the same as those in FIG. 8(part (b)).

Next, how the surface electrical charge Qp of the photosensitive drum 101 can be calculated without involving the electrostatic capacity Ca1 between the peripheral surface of the photosensitive drum 101 and antenna 201, and the electrostatic capacity Ca2 between the peripheral surface of the photosensitive drum 101 and antenna 202, is described.

First, referring to FIG. 8(part (a)), the electrostatic capacity Cas1 of the combination of electrostatic capacity Ca1 and electrostatic capacity Cs1 can be expressed in the form of the following mathematical formula (8).

$$C_{as1} = \frac{C_{a1} C_{s1}}{C_{a1} + C_{s1}} \tag{8}$$

Further, there is a relationship (mathematical formula (9)) between the measured potential level Va1 and potential level Vd1 of the photosensitive drum 101, based on the partial voltage calculation of a serial circuit.

$$V_{a1} = \frac{C_{a1}}{C_{s1} + C_{a1}} \cdot V_{d1} = \frac{C_{a1}}{C_{s1} + C_{a1}} \cdot \frac{Q_p}{C_{as1} + C_p} \tag{9}$$

As Cas1 is eliminated from mathematical formulas (8) and (9), and the remaining terms are rearranged with regard to Ca1, the following mathematical formula (10) is obtained.

$$C_{a1} = \frac{C_p C_{s1} V_{a1}}{Q_p - (C_p + C_{s1}) V_{a1}} \tag{10}$$

Next, referring to FIG. 8(part (b)), the following mathematical formula (11) can be obtained through the similar process.

$$C_{a2} = \frac{C_p C_{s2} V_{a2}}{Q_p - (C_p + C_{s2}) V_{a2}} \tag{11}$$

The above-described mathematical formula (6) holds true also with the potential-based method. Thus, as Ca1 and Ca2 are eliminated from mathematical formulas (6), (10) and (11), and the remaining terms are rearranged with respect to Qp, the following mathematical formula (12) is obtained.

$$Q_p = \left(C_{s1} - C_{s2} - \frac{C_{s1}C_{s2}}{C_a}\right) \cdot \frac{C_p V_{a1} V_{a2}}{C_{s1} V_{a1} - C_{s2} V_{a2}} \tag{12}$$

Potential levels Va1 and Va2 in the mathematical formula (12) are the values of the potential levels of the antennas 201 and 202, which were measured by the potential-based method, and Cs1, Cs2 and Ca (amount of difference between electrostatic capacity Ca1 (which has fixed value) and electrostatic capacity Ca2 (which has fixed value)) are fixed in value. Therefore, also in potential-based method, by employing two antennas 201 and 202, it is possible to accurately calculate the surface electrical charge Qp of the photosensitive drum 101, without depending upon the distance (that is, electrostatic capacities Ca1 and Ca2 between two antennas and photosensitive drum) between the antenna 201 and photosensitive drum 101, and the distance between the antenna 202 and photosensitive drum 101. Further, the surface electrical charge Vp of the photosensitive drum 101 can be calculated from the relationship among Vp, Qp and Cp (Vp=Qp/Cp).

Shown in FIG. 9(part (a)) are the potential levels Va1 and Va2 of the antennas 201 and 202 measured by the potential-based method. The distance between the antenna 202 and photosensitive drum 101 is greater by 200 [μm], for example, than the distance between the antenna 201 and photosensitive drum 101. Further, the horizontal axis represents the distance d0 between the antenna 201 and photosensitive drum 101, and the surface potential level of the photosensitive drum 101 was 600 [V]. It is evident from FIG. 9(part (a)) that the greater the distance d0, the smaller the measured amount of potential level of the photosensitive drum 101.

Shown in FIG. 9(part (b)) is the surface potential level of the photosensitive drum 101 obtained through the calculation based on the measured amounts of the electrical charge of the antennas 201 and 202. In the case of the potential-based method which employs two antennas (two antenna system), the mathematical formula (1) was for calculation. In the case of the potential-based method which employs a single antenna, the coefficient was set so that when the distance d0 is 1 [mm], the potential level of the photosensitive drum 101 becomes 600 [V]. It is evident from FIG. 9(part (b)) that the greater the distance d0, the smaller the value of the surface potential level of the photosensitive drum 101 calculated based on the signals from the single antenna. In particular, looking at the portion of FIG. 9(part (b)) where the distance d0 is roughly 1 [mm], it is evident that a mere ±0.5 [mm] of error in the positioning (distance d0) of the antenna results in several hundred volts of error in the calculated potential level. In comparison, the potential level of the photosensitive drum 101 calculated based on the signals from two antennas was equal to the potential level given to the photosensitive drum 101, regardless of the distance d0.

As the electrostatic latent image (electrostatic image) is moved, the detecting section 3, as a detection circuit, detects the electrical potential induced in the antennas 201 and 202. The control section 80, as a computing means, computes the potential level of the electrostatic image, based on the electrical outputs (potential levels) outputted by the antennas 201 and 202.

As described above, in this embodiment, the sensor head portion 2 has the guard electrodes 204, which are positioned outside the area between the two antennas 201 and 202, and photosensitive drum 101, in such a manner that the electrostatic capacity between the antenna 201 and guard electrode 204 becomes different from the electrostatic capacity between the antenna 202 and guard electrode 204. It is assumed here that the potential levels, as the electrical outputs, of the antennas 201 and 202 are Va1 and Va2, and the electrostatic capacity between the antennas 201 and 202 and guard electrodes 204 are Cs1 and Cs2. The control section 80 which uses the potential-based method calculates the surface electrical charge Qp of the photosensitive drum 101, which induces Va1 and Va2, with the use of the above described mathematical formula (12), and then, calculates the potential level of the electrostatic latent image, based on the surface potential level Vp of the photosensitive drum 101 calculated with the use of the equation (Vp=Qp/Cp).

It is evident from the description of the potential-based method that even with the use of the potential-based method, by computing with the use of the mathematical formula (12), it is possible to accurately calculates the surface potential level of the photosensitive drum 101, without involving the distances between the antennas 201 and 202, and photosensitive drum 101.

In the foregoing, the computing method which uses the current-based method to calculate the surface potential level of the photosensitive drum 101, without involving the distances between the antennas 201 and 202, and the photosensitive drum 101, and the computing method which uses the potential-based method to calculate the surface potential level of the photosensitive drum 101 without involving the distances between the antennas 201 and 202, and photosensitive drum 101, were described.

[Application of Potential Level Sensor to Image Forming Apparatus]

Next, the workings of the electrophotographic image forming apparatus 10 which employs the potential level sensor 102, as an integral part of the potential level detection system, in this embodiment, is described.

Unlike a potential level sensor which uses a zero method, the potential level sensor 102 in this embodiment does not have a high voltage circuit. Therefore, one of its characteristics is that it is fast in response. Because of this characteristic, it can measure the potential level of the photosensitive drum 101 during a very short period, more specifically, during the period in which the portion (which hereafter will be referred to as "image interval portion") of the peripheral surface of the photosensitive drum 101, which is between the preceding and following images on the photosensitive drum 101, passes through the area in which the peripheral surface of the photosensitive drum 101 faces the potential level sensor 102, and feed back the measured potential level to the voltage to be applied to the charging device, and the exposure intensity of the exposing device. Further, as stated in the description of the computing method based on the output of the potential level sensor 102, this potential level sensor 102 measures the amount of change in potential level (relative value). It is desired that this potential level sensor 102 is integrated as a part of the potential level detection system of the image forming apparatus 10 to obtain the absolute value of the potential level of the photosensitive drum 101.

Hereafter, the image forming apparatus 10 which employs the potential level sensor 102 in this embodiment is described about its operation (A) for detecting the surface potential level of the photosensitive drum 101 during image intervals, and its operation (B) for obtaining the absolute value of the surface potential level of the photosensitive drum 101.

[Image Forming Apparatus Employing Charging Roller]

To begin with, referring to FIGS. 11 and 12, the application of this embodiment to an image forming apparatus which employs a charging roller is described. FIG. 10 is an extraction of a part of FIG. 1, more specifically, a part which includes one of the image forming stations of the image forming apparatus 10. The charging device 108 in this image formation station is a charging roller. FIG. 11 shows the waveform of the measured potential level of the peripheral surface of the photosensitive drum 101 of the image forming apparatus 10 which employs a charging roller, and that of a latent image patch. FIG. 12 is a flowchart of the image forming operation carried out by the image formation station shown in FIG. 10.

The charging roller (108) in FIG. 10 is in connection with an unshown high voltage electric power source, which applies high voltage bias, which is a combination of AC voltage (2 [kHz], 1 [kVpp], for example) and DC voltage (−700 V, for example) to the charging roller (108). Also referring to FIG. 10, the laser scanner 103 and charging roller (108) are in connection to the control section 80 (FIG. 1).

The employment of the charging roller (108) makes the image forming apparatus 10 excellent in the potential level convergence of the photosensitive drum 101. That is, as the photosensitive drum 101 is charged by the charging roller (108), the potential level Vd of the photosensitive drum 101 becomes roughly equal to the voltage of the DC component of the high voltage bias applied to the charging roller (108). After the changing of the peripheral surface of the photosensitive drum 101 by the charging roller (108), a latent image patch of a preset size is formed on the photosensitive drum 101 with the use of the laser scanner 103. Then, the potential level of the latent image is measured by the potential level sensor 102, to obtain the difference (Vl−Vd) between the potential level of the photosensitive drum 101 prior to the exposure and that after the exposure. That is, the potential level Vd to which the photosensitive drum 101 was charged is obtained based on the DC component of the high voltage bias applied to the charging roller (108), and then, the potential level Vl of the exposed portion of the peripheral surface of the photosensitive drum 101 is measured by the potential level sensor 102.

Referring to FIG. 11, the pattern of the latent image patch on the photosensitive drum 101 is contoured by a broken line, and the waveform of the output potential level sensor 102 is indicated by a solid line. Here, the distance between the antenna and photosensitive drum 101 is 1 [mm]. In this case, the area of the peripheral surface of the photosensitive drum 101, the potential level of which is measured by the antenna is roughly 3.5 [mm], because of the spread of the electric field. That is, the measured waveform is as wide as 3.5 [mm] at the peripheral surface of the photosensitive drum 101. The responsiveness of the potential level sensor 102 is dependent upon only the time constant of the circuit, being therefore satisfactorily fast (time constant of circuit is negligibly small). Thus, all that needs to be taken into consideration is the spreading of the electric field. In other words, the difference between Vl and Vd can be satisfactorily measured by forming the latent image patches so that they become 5 [mm] in length V1, and 12 [mm] in interval.

Further, when the image forming apparatus 10 in this embodiment is used for forming an image on sheets of recording medium of a size A4, the image interval is set to 50 [mm]. Thus, three of the above-described latent image can be formed per image interval. The pre-exposure potential level Vd (unexposed area potential level, charged area potential level) is set to −600 V, and exposed area potential level Vl is set to −100 [V]. As described previously, the potential level Vd to which the photosensitive drum 101 is charged is equal to the voltage of the DC component of the charge bias applied to the charging roller (108). Thus, by obtaining the difference between Vl and Vd based on the outputs of the potential level sensor 102, it is possible to obtain the absolute values of the unexposed area potential level Vd (charged area potential level) and exposed area potential level Vl. Moreover, three latent image patches are measured in potential level, and the average potential level of the three latent image patches is used for calculation to minimize the effects of noise.

As described above, the potential level sensor 102 in this embodiment is fast in response. Therefore, it can measure the potential level of the peripheral surface of the photosensitive drum 101 during a single image interval, and continuously feed the results of the measurement to the control section 80 to control the voltage applied to charge the photosensitive drum 101 and the exposure light intensity. Next, this operation is described with reference to the flowchart in FIG. 12.

After the control section 80 starts the image forming apparatus 10 to start a job (S1), it begins to drive the photosensitive drum 101, intermediary transfer belt 115, and developing device 104, and turns on the charge bias to prepare the image forming apparatus 10 for the job (S2). Then, the control section 80 drives the laser scanner 103 to form a latent image patch for potential level detection, on the photosensitive drum 101, and measures the potential level of the latent image patch with the use of the potential level sensor 102 (S3). During the preceding steps, the biases for the developing device 104 and primary transfer roller 113 are kept turned off. Therefore, the latent image patch is not developed nor transferred, and is erased by the charging roller (108).

Next, the control section 80 checks whether or not the value obtained by the potential level sensor 102 is within a target range (S4). If the value is not within the target range, the control section 80 controls the exposing device in exposure light intensity (S5). More concretely, if the exposed area potential level Vl measured by the potential level sensor 102 is greater than a target value (for example, measure potential level Vl is −50 V, which is greater than target value −100 [V], the control section 80 reduces the exposure light intensity to reduce the exposure area potential level Vl. On the other hand, if the measured potential level Vl is smaller than the target value (for example, measure potential level Vl is −150 [V], being smaller than target value −100 [V]), the control section 80 increases the exposing device in exposure light intensity to increase the exposed area potential level Vl. This process of controlling the exposing device in exposure light intensity is repeated until the exposed area potential level Vl falls within the target range. Then, as the exposed area potential level falls within the target range, the control section 80 makes the image forming apparatus 10 start printing (S6).

After the starting of the actual printing operation, the control section 80 turns on the biases for the developing device 104 and primary transfer roller 113 (S7) to begin with. During the printing operation, the control section 80 forms latent image patches during image intervals, that is, while no image is formed, and measures the potential level of the latent image patch with the use of the potential level sensor 102 (S8). Then, the control section 80 checks whether or not the job has been completed (S9). If it determines that the job has not been completed, it continues to control the exposing device in exposure light intensity in order to make the measured potential level falls within the target range (S10). This potential level sensor 102 is fast in response, being therefore capable of measuring the potential level of the latent image patches during a single image interval, to enable the control section 80 to continuously control the photosensitive drum 101 in surface potential level. As soon as the control section 80 detects that the job has been completed, it stops the bias application and driving of the developing device 104 and primary transfer roller 113 (S11), and ends the printing operation (S12).

As described above, this embodiment can enable an image forming apparatus which charges its photosensitive drum with the use of its charging roller (108), to obtain the absolute value of the unexposed area potential level Vd (charged area potential level), and the absolute value of the exposed area potential level Vl, and also, to highly precisely control the potential level of the photosensitive drum 101 by detecting the potential level of the photosensitive drum 101 during image intervals.

[Image Forming Apparatus Employing Corona Charging Device]

Next, referring to FIGS. 13, 14 and 15, the application of the present invention (this embodiment) to an image forming apparatus which employs a corona charging device is described. FIG. 13 is an extraction of a part of FIG. 1, more specifically, one of the image formation sections in FIG. 1. The charging device 108 of this image forming apparatus is a corona charging device. FIG. 14 shows the waveform of the potential level of the peripheral surface of the photosensitive drum 101 of the image forming apparatus employing the corona charging device, and a latent image patch. FIG. 15 is a flowchart of the image forming operation of the image forming apparatus shown in FIG. 13.

Referring to FIG. 13, the corona charging device (103) is of the scorotron-type, and has: discharge wire; electrically conductive shield, which is U-shaped in cross section, and surrounds the discharge wire; and a grid electrode positioned in the opening of the shield. The corona charging device (108) is structured so that charge bias, which is DC voltage, is applied to the discharge wire and grid electrode. It has a function of uniformly and negatively charging the peripheral surface of the photosensitive drum 101, with the use of the charge bias provided by an electric power source.

Referring to FIG. 13, there is provided a Vd sensor 120 between the corona charging device (108) and potential level sensor 102, being positioned so that it faces the peripheral surface of the photosensitive drum 101, with the presence of a preset distance between itself and the photosensitive drum 101. The corona charging device (108) and Vd sensor 120 are in connection to a charge controlling device 118 which is in connection to the control section 80 (FIG. 1).

In this embodiment, the Vd sensor 120 and charge controlling device 118 are used to control the unexposed area potential level Vd (charged area potential level). The Vd sensor 120 is a potential level sensor which uses the zero method, for example. It is a sensor capable of measuring the absolute value of the peripheral surface potential level of the photosensitive drum 101.

As in the case where a charging roller is used, the difference (Vl−Vd) between the potential level (Vl) of the peripheral surface of the photosensitive drum 101 after exposure and that (Vd) prior to exposure can be obtained by forming latent image patches of a preset size on the peripheral surface of the photosensitive drum 101 by the laser scanner 103, and measuring the potential level of the latent image patches with the use of the potential level sensor 102. That is, the unexposed area potential level (charged area potential level) is obtained by the Vd sensor 120, and the exposed area potential level Vl is measured by the potential level sensor 102.

The reason why the exposed area potential level Vl is measured by the potential level sensor 102 is that the potential level sensor 102 is fast in response time, whereas the Vd sensor 120 is slow in response time. Therefore, it is difficult to detect the potential levels (Vd and Vl) during an image interval with the use of the Vd sensor 120. To concretely describe the reason, realistically, the response time (startup time) of the Vd sensor 120 is roughly 60 [msec] at 1 [kV]. Assuming that the peripheral velocity of the photosensitive drum 101 is 300 [ram/sec], this response time is equivalent to 18 [mm] of movement of the peripheral surface of the photosensitive drum 101 (60 [msec]×300 [mm/sec]=18 [m]).

If the Vd sensor 120 is used to measure the exposed area potential level Vl, the size of the latent image patch, which corresponds to this response time of 18 [mm], is 28 [mm] including 5 [mm] of latitude, for example, on the front and rear sides. Thus, in consideration of the spread of the electrical field (3.5 [mm] in frontward and rearward directions), the total is 35 [mm] (=18 [mm]+10 [mm]+7 [mm]). Thus, the number of latent image patches which fit in each image interval, which is 50 [mm], is only one. Thus, it is impossible to obtain average value of the exposed area potential level Vl. That is, it is impossible to obtain the exposed area potential level Vl at a satisfactorily high level of accuracy. This is the reason why it is difficult to measure the exposed area potential level Vl with the use of the Vd sensor 120 during an image interval.

Referring to FIG. 14, the latent image on the photosensitive drum 101 is contoured by a broken line, and the waveform of the output signal of the potential level sensor 102 is shown in a solid line. The antenna was set 1 [mm] above (away) from the photosensitive drum 101. Thus, the area of the peripheral surface of the photosensitive drum 101, which is measured in potential level by the antenna was roughly 3.5 [mm] due to the spread of the electric field.

Therefore, the measured waveform is as wide as 3.5 [mm] at the peripheral surface of the photosensitive drum 101. The responsiveness of the potential level sensor 102 is dependent upon only the time constant of the circuit, being therefore satisfactorily fast (time constant of circuit is negligibly small). Thus, all that needs to be taken into consideration is the spreading of the electric field. In other words, the difference between Vl and Vd can be satisfactorily measured by forming the latent image patches so that they become 5 [mm] in length V1, and 12 [mm] in interval. With the image interval set to 5 [mm], it is possible to measure three latent image patches in each image interval. Thus, it is possible to reduce the effects of noise by averaging the results of the measurement of the three latent image patches. The unexposed area potential level Vd (charged area potential level) is continuously measured by the Vd sensor 120. Thus, the absolute values of the Vd and Vl can be obtained by measuring the unexposed area potential level Vd by the Vd sensor 120, and measuring the (Vl−Vd) by the potential level sensor 102.

As described above, the potential level sensor 102 in this embodiment is fast in response, being therefore capable of measuring the potential level during a single image interval, and continuously feeding back the measured potential level to the voltage to be applied for charging the photosensitive drum 101, and exposure light intensity. This operational sequence is described with reference to the flowchart (FIG. 15).

After the control section 80 starts the image forming apparatus 10 to start a job (S21), it begins to drive the photosensitive drum 101, intermediary transfer belt 115, and developing device 104, and turns on the charge bias to prepare the image forming apparatus 10 for the job (S22). Then, the control section 80 measures the unexposed area potential level Vd (charged area potential level) by Vd sensor 120 (S23), and checks whether or not the unexposed area potential level Vd is within a target range (S24). If the unexposed area potential level Vd is not in the target range, the control section 80 sends a command to the charge level controlling device 118 to control the charge bias in order to make the unexposed area potential level Vd fall within the target range (S25).

Next, the control section 80 forms a latent image patch for potential level detection, on the peripheral surface of the photosensitive drum 101 with the use of the laser scanner 103, and measures the potential level of the latent image patch by the potential level sensor 102 (S29). During these steps, the biases for the developing device 104 and primary transfer roller 113 are kept off. Therefore, the latent image patch is not developed or transferred, and is erased by the corona charging device (108) which is a charging device.

Then, the control section 80 checks whether or not the value measured by the potential level sensor 102 is within a target range (S30). If it is not in the target range, it controls the exposure light intensity by sending a command to the charge controlling device 118 (S31). More concretely, if the exposed area potential level Vl measured by the potential level sensor 102 is greater than a target value (for example, measure potential level Vl is −50 V, which is greater than target value −100 [V]), the control section 80 reduces the exposure light intensity to reduce the exposure area potential level Vl. On the other hand, if the measured potential level Vl is smaller than the target value (for example, measure potential level Vl is −150 [V], being smaller than target value −100 [V]), the control section 80 increases the exposure light intensity to increase the exposed area potential level Vl.

During these steps, the control section 80 controls the unexposed area potential level Vd (charged area potential level) with the use of the Vd sensor 120 (S26-S28) to continuously keep the unexposed area potential level Vd in the preset range. These processes of controlling the charged area potential level and controlling the exposure light intensity are repeated until the unexposed area potential level Vd (charged area potential level) and exposed area potential level Vl fall within their target ranges. Then, as the unexposed area potential level Vd (charged area potential level) and exposed area potential level fall within their target ranges, the control section 80 makes the image forming apparatus 10 start printing (S32).

As soon as the control section 80 starts the actual printing job, it turns on the biases for the developing device 104 and primary transfer roller 113 (S33). The control section 80 continues to measure the Vd, control the charge bias (S34-S36), and also, measure the exposed area potential level Vl, and control the exposure light intensity during image intervals (S37, S35 and S38), in order to ensure that the unexposed area potential level Vd (charged area potential level) and exposed area potential level Vl fall within the target ranges. As soon as the job is completed, the control section 80 turns off the biases and stops driving the developing device 104 and primary transfer belt 113 (S39), and stops the printing operation (S40).

As described above, in the case of an image forming apparatus which employs a corona charging device, the unexposed area potential level Vd and exposed area potential level Vl can be kept always stable by continuously detecting the exposed area potential level Vl by the Vd sensor 120, and detecting the unexposed area potential level Vd by the potential level sensor 102 during image intervals. Thus, it is possible to obtain satisfactory images.

To summarize the description of this embodiment given above, the potential level sensor 102 in this embodiment is provided with two antennas 201 and 202 which are different in electrostatic capacity, and the signals from which are analyzed to obtain the potential level of the peripheral surface of the photosensitive drum 101. Thus, it does not require a high voltage power source, a driving system, etc., unlike a potential level sensor which uses the zero method. Therefore, it is simple in structure and inexpensive. Further, it is not affected by the distances between its antennas 201 and 202, and the photosensitive drum 101 which is the object of measurement. Therefore, it can accurately detect the potential level of the photosensitive drum 101. One of its characteristics is fast in response. Therefore, its application to the image forming apparatus 10 makes it possible to measure the potential level of the peripheral surface of the photosensitive drum 101 during image intervals to continuously control the potential levels (Vd and Vl).

Embodiment 2

Next, the second embodiment of the present invention is described. By the way, the components, portions thereof, etc., of the image forming apparatus 10 and its potential level sensor 102 in this embodiment, which are the same in structure and function as the counterparts in the first embodiment, are given the same referential codes as those given to the counterparts, and are not described.

It is possible that the potential level sensor 102 will become tilted relative to the photosensitive drum 101 due to the errors which occur when the potential level sensor 102 is attached, and/or changes in temperature. First, therefore, the effects of this tilting of the potential level sensor 102 are described. More concretely, as the above described potential level sensor 102 in the first embodiment, which has the antennas 201 and 202, becomes tilted, the difference Ca (defined by mathematical formula (6)) between the electrostatic capacities Ca1 and Ca2 of the antennas 201 and 202, respectively, which are not to vary, changes, which results in error in the calculated potential level. In this embodiment, therefore, in order to eliminate the effects of this tilting of the potential level sensor 102, the potential level sensor 102 in this embodiment is provided with three antennas 201, 202 and 203, the output signals of which are used for the computation of the potential level of the peripheral surface of the photosensitive drum 101. By the way, in this embodiment, the antenna 202 functions as the first antenna electrode, and the combination of the antennas 202 and 203 functions as the second antenna electrode.

In this embodiment, the potential level sensor 102 has: the antenna 201 as the first antenna electrode; antenna 202 as one of the two second antenna electrodes; and antenna 203 as the other second antenna electrode. The antennas 202 and 203 are positioned so that the electrostatic capacity between the antenna 202 (second antenna electrode) and antenna 201 (first antenna electrode), and the electrostatic capacity between the antenna 203 (second antenna electrode) and antenna 201 (first antenna electrode) become the same.

Also in this embodiment, the potential level sensor 201 is the potential level detecting means, and has a detecting section 3 and a computing section 4, such as those shown in FIG. 2. The detecting section 3 in this embodiment is a detection circuit which detects induction currents which the movement of the electrostatic latent image (electrostatic image) induces in the antennas 201 and 202. Based on the electrical signals outputted from the antennas 201, 202 and 203 as the electrostatic latent image formed on the peripheral surface of the photosensitive drum 101 moves, the computing section 4 computes in such a manner that the changes in the electrostatic capacity between the antenna 201 and photosensitive drum 101, electrostatic capacity between the antenna 202 and photosensitive drum 101, and electrostatic capacity between the antenna 203 and photosensitive drum 101 are eliminated.

Then, the computing section 4 calculates the potential level of the electrostatic image formed on the peripheral surface of the photosensitive drum 101. That is, the computing section 4, as the computing means, calculates the potential level of the electrostatic image, based on the electrical outputs (current, voltage) from the detecting section 3.

Next, the characteristic features of this embodiment are described. FIG. 16(part (a)) is a schematic drawing of the potential level sensor 102 in this embodiment, which is in the state in which the sensor head portion 2 of the potential level sensor 102 has become tilted. Referring to FIG. 16(part (a)), the sensor head portion 2 of the potential level sensor 102 in this embodiment has three antennas 201, 202 and 203.

The antennas 201, 202 and 203 are positioned so that the antenna 201 is at the apex of the equilateral triangle which the three antennas form, and the antennas 202 and 203 are at the two base angles of the triangle, one for one. They are embedded in the insulative portion 205, described with reference to FIGS. 4 and 5, being thereby fixed in positional relationship (FIG. 18). The antennas 201, 202 and 203 are positioned, as the antennas 201 and 202 are as shown in FIGS. 3 and 4, so that a preset distance is maintained between them and adjacent guard electrodes 204.

In the first embodiment, the amount Ca of difference in electrostatic capacity between the two antennas 201 and 202 had a fixed value. However, as the sensor head portion 2 tilts as shown in FIG. 16(part (a)), the amount Ca changes, for the following reason.

First, when the sensor head portion 2 is level as indicated by broken lines in FIG. 16(part (a)), the electrostatic capacity Ca1 between the antennas 201 and 202 can be defined by the following mathematical formula (13), provided that the antennas 201, 202 and 203 are thin enough.

$$C_{a1} = \varepsilon \frac{S}{d_1} \tag{13}$$

In comparison, if the sensor head portion 2 rotationally moves about the center of the antenna 201 by an angle θ as indicated by solid lines in FIG. 16(part (a)), the amount d11 of difference between the distance between the antenna 201 and the photosensitive drum 101, and the distance between the antenna 203 and photosensitive drum 101 can be calculated with the use of the following mathematical formula (14), in which g1 stands for the horizontal distance between the antennas 201 and 203 when the potential level sensor 102 is level, and d1 is the vertical distance between the bottom of the antenna 201 and the bottom of the antenna 203.

$$d_{11} = d_1 - d_1 \cos\theta - g_1 \sin\theta \tag{14}$$

Therefore, it is evident that when the sensor head portion 2 is tilted, the amount Cal1 of difference in the electrostatic capacity between the antennas 201 and 203 can be defined by the following mathematic formula (15). That is, the amount Cal1 of difference in the electrostatic capacity is dependent on the angle θ.

$$C_{a11} = \varepsilon \frac{S}{d_{11}} = \varepsilon \frac{S}{d_1 - d_1\cos\theta - g_1\sin\theta} \tag{15}$$

Therefore, as the sensor head portion 2 tilts, the electrostatic capacity Ca changes. Thus, the potential level computed with the use of the above-described mathematical formulas (17) and (12) has an error. The actual amount of the error will be described later. In this embodiment, therefore, the third antenna 203 is employed to eliminate (compensate for) the effects of the tilting of the sensor head portion 2.

[Computing Method Using Three Antennas]

Next, referring to FIGS. 16(part (b)) and 17, the potential level computing method based on three antennas is described. Here, only the current-based method is described. By the way, FIG. 16(part (b)) is a schematic drawing of the sensor head portion 2 approximated to simplify the calculation. FIG. 17 is an equivalent circuit of the sensor head portion 2 having the three antennas.

In the case of the approximated model in FIG. 16(part (b)), it is assumed that as the element holder 30 tilts (rotationally moves) about the center of the antenna 201, the antenna 202 moves toward the photosensitive drum 101 by a distance dx, and the antenna 203 moves away from the photosensitive drum 101 by the distance dx. Here, the computation is done with the use of the current-based method. Therefore, the electrical charges Qa1, Qa2 and Qa3 induced in the antennas 201, 202 and 203 are measured.

Referring to FIG. 17, the three antennas 201, 202 and 203 are positioned close to each other. Therefore, the three equivalent circuits are the same in the amount of the surface electrical charge Qp and electrostatic capacity Cp of the photosensitive drum 101. Next, it is shown that the surface potential level of the photosensitive drum 101 can be calculated without involving the angle (tilting) of the sensor head portion 2 (dx in FIG. 16(part (b))).

First, the electrostatic capacity Ca12 between the antennas 201 and 202, and the electrostatic capacity Ca13 between the antennas 201 and 203, can be expressed in the form of the following mathematical formulas (16) and (17).

$$C_{a12} = \varepsilon \frac{S}{d_1 + d_x} \tag{16}$$

$$C_{a13} = \varepsilon \frac{S}{d_1 - d_x} \tag{17}$$

Here, the distance d1 is the distance between the antenna 201 and 202, and also, the distance between the antennas 201 and 203. It becomes fixed (fixed value) when the sensor head portion 2 is manufactured. As dx is eliminated from the formulas (16) and (17), the following formula (18) is obtained.

$$2d_1 = \varepsilon S\left(\frac{1}{C_{a12}} + \frac{1}{C_{a13}}\right) \tag{18}$$

Further, the application of the formula (7) in the first embodiment to the relationship between the antennas 201 and 202, and the relationship between the antennas 201 and 203, yields the following mathematical formulas (19) and (20).

$$Q_p = \frac{Q_{a1}Q_{a2}}{Q_{a2} - Q_{a1}} \cdot \frac{C_p}{C_{a12}} \tag{19}$$

$$Q_p = \frac{Q_{a1}Q_{a2}}{Q_{a2} - Q_{a1}} \cdot \frac{C_p}{C_{a13}} \tag{20}$$

As the electrostatic capacity Ca12 between the antennas 201 and 202, and the electrostatic capacity Ca23 between the antennas 201 and 203, are eliminated from the formulas (18)-

(20), and the remaining terms are rearranged with respect to Qp, the following formula (21) is obtained.

$$Q_p = \frac{2C_p}{C_a} \cdot \frac{Q_{a1}Q_{a2}Q_{a3}}{2Q_{a2}Q_{a3} - Q_{a1}Q_{a3} - Q_{a1}Q_{a2}} \quad (21)$$

However, Ca in formula (21) is defined by an equation (Ca=∈S/d1). It equals the electrostatic capacity of the antennas 201 and 202, and the electrostatic capacity between the antennas 201 and 203. This electrostatic capacity Ca has only to be measured when the sensor head portion 2 is manufactured. In other words, it is not affected by the errors which might occur during the attachment of the sensor head portion 2. That is, it remains fixed.

Thus, in mathematical formula (21), Cp (electrostatic capacity of photosensitive drum 101), and Ca (electrostatic capacity between antennas 201 and 202, electrostatic capacity between antennas 201 and 203 when sensor head portion 2 is not tilted), have fixed values, whereas Qa1, Qa2 and Qa3 (electrical charge induced in three antennas 201, 202 and 203, respectively) are variable (measured). Therefore, by employing three antennas 201, 202 and 203, it is possible to calculate the surface electrical charge Qp of the photosensitive drum 101, without being affected by the tilting of the sensor head portion 2. Once the value of Qp is calculated, surface potential level Vp can be calculated based on the relationship (Vp=Qp/Cp) among Vp, Qp and Cp (Vp: surface potential level of photosensitive drum 101; Qp: surface electrical charge of photosensitive drum 101; and Cp: electrostatic capacity of the photosensitive drum 101). The foregoing is the computing method based on the three antennas.

As described above, the computing section 4 which uses the current-based method uses electrical charges Qa1, Qa2 and Qa3 induced in the antennas 201, 202 and 203, respectively, and electrostatic capacity Cp of photosensitive drum 101. It uses also the electrostatic capacity Ca between the antenna 201 (first antenna electrode) and antenna 202 (second antenna electrode), and Ca between the antennas 201 and 203 when the sensor head portion 2 having the antennas 201-203 is not tilted relative to the photosensitive drum 101. It calculates the surface potential level Qp of the photosensitive drum 101, which induces electrical charges Qa1, Qa2 and Qa3, with the use of the mathematical formula (21), and then, calculates the potential level of the electrostatic latent image (electrostatic image), based on the surface potential level Vp of the photosensitive drum 101 calculated with the use of the relationship (Vp=Qp/Cp).

Next, referring to FIGS. 18, 19(part (a)) and 19(part (c)), the effects of the computing method based on the three antennas is described.

FIG. 18 is a sectional view of the sensor head portion 2 having the three antennas 201, 202 and 203. Here, it is assumed that the vertical distance d1 between the bottom surface of the antennas 201 and the bottom surface of the antenna 202, and the vertical distance d1 between the bottom surface of the antennas 201 and the bottom surface of the antenna 203, are 200 [μm]; the horizontal distance g1 between the center of the antenna 201 and the center of the antenna 202, and the horizontal distance g1 between the center of the antenna 201 and the center of the antenna 203 are both 1 [mm]; and the dielectric constant ∈ of the insulative portion 205 is 3 (∈=3). By the way, in order to make the antennas 201, 202 and 203 different in electrostatic capacity relative to the photosensitive drum 101, the potential level sensor 102 shown in FIG. 18 is structured so that the antennas 201, 202 and 203 become different in their distance from the photosensitive drum 101. However, the potential level sensor 102 may be structured so that the antennas 201, 202 and 203 become different in dielectric constant, based on the relationship (c)=∈/d).

FIG. 19(part (a)) shows the measured electrical charge of each of the three antennas of the sensor head portion 2 when the sensor head portion 2 has rotationally moved by a certain angle about the center of the antenna 201. The surface potential level of the photosensitive drum 101 was 600 [V]. As described above with reference to FIGS. 16(part (a)) and 16(part (b)), the antenna 201 does not change in the measured amount of electrical charge even if the sensor head portion 2 becomes tilted. However, as the sensor head portion 2 becomes tilted, the antennas 202 and 203 change in their distance to the photosensitive drum 101, and therefore, change in the measured amount of electrical charge.

FIG. 19(part (b)) is a graph which shows the potential levels of the photosensitive drum 101 obtained through the computation based on a combination of the two antennas and a combination of the three antennas. In the case of the computation based on the two antennas, mathematical formula (7) was used, whereas in the case of the computation based the three antennas, the mathematical formula (21) was used. As is evident from FIG. 19(part (b)), the surface potential level calculated based on the outputs of the two antennas 201 and 202 has errors, the amount of which reflects the angle of the sensor head portion 2. In comparison, the surface potential level based on the outputs of the three antennas 201, 202 and 203 is 600 [V], which is the preset value, regardless of the angle of the sensor head portion 2.

That is, it is evident that with the computation made with the use of the mathematical formula (21), it is possible to eliminate the effects of the angle of the sensor head portion 2, and therefore, to more accurately calculate the surface potential level of the photosensitive drum 101. In other words, according to this embodiment, not only is it possible to obtain roughly the same results as those obtainable by the first embodiment, but also, it is possible to compensate for the effects of the angle of the sensor head portion 2, and therefore, to more accurately calculate the surface potential level of the photosensitive drum 101.

As described above, in the case of a conventional potential level sensor for measuring the surface potential level of a photosensitive member, changes in the distance between a photosensitive member and a probe resulted in the errors in the measured potential level of the photosensitive member. Thus, it was a common practice to apply to the probe, the same amount of voltage as the one applied to the photosensitive member, in order to eliminate the effects of this change in the distance. This method, however, is rather high in cost, and also, cannot increase the high voltage circuit in responsiveness. Therefore, it is limited in terms of the potential level detection timing, being therefore problematic from the standpoint of highly precisely keeping the potential level of a photosensitive member at a preset level. In comparison, in the case of the first and second embodiments of the present invention, at least two antennas, which are different in their distance from the photosensitive drum 101, are employed, and the potential level of the photosensitive drum 101 is computed based on the outputs of the antennas. Thus, they are not affected by the distance between the antenna and photosensitive drum 101. Therefore, they can accurately calculate the surface potential level of the photosensitive drum 101. Therefore, they can effectively prevent the occurrence of the changes in image density, color tone, etc., which are attributable to the changes in the potential level of the photosensitive drum 101.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 001050/2014 filed Jan. 7, 2014, which is hereby incorporated by reference.

What is claimed is:

1. A detecting device for detecting a surface potential of a photosensitive member, said detecting device comprising:

a first electrode adapted to be positioned with a space relative to a surface of the photosensitive member;

a second electrode adapted to be positioned relative to the surface of the photosensitive member at a distance from said first electrode away from the surface;

a third electrode electrically grounded and provided at a position remoter from said photosensitive member than said first electrode and said second electrode;

a first detecting portion configured to detect induced charge in said first electrode;

a second detecting portion configured to detect induced charge in said second electrode; and a calculating portion configured to calculate a surface potential of the photosensitive member on the basis of an output of said first detecting portion and an output of said second detecting portion.

2. A device according to claim 1, wherein said calculating portion calculates such that a component resulting from a variation of a distance between the photosensitive member and said first electrode with rotation of the photosensitive member is canceled.

3. A device according to claim 1, wherein said calculating portion determines charge Qp of the surface of the photosensitive member producing the induced charge Qa1 and Qa2 by the following expression, $$Q_p = \frac{Q_{a1}Q_{a2}}{Q_{a2} - Q_{a1}} \cdot \frac{C_p}{C_a}$$

where Qa1 is induced charge detected by said first detecting portion, Qa2 is induced charge detected by said second detecting portion, Ca is an electrostatic capacity between said first electrode and said second electrode, and Cp is an electrostatic capacity of said photosensitive member, and said calculating portion calculates the surface potential of the photosensitive member by Qp and Cp.

4. A detecting device for detecting a surface potential of a photosensitive member, said detecting device comprising:

a first electrode adapted to be positioned with a space relative to a surface of the photosensitive member;

a second electrode adapted to be positioned relative to the surface of the photosensitive member at a distance from said first electrode away from the surface;

a third electrode position at a predetermined distance from said first electrode away from the surface of the photosensitive member;

a first detecting portion configured to detect induced charge in said first electrode;

a second detecting portion configured to detect induced charge in said second electrode;

a third detecting portion configured to detect induced charge in said third electrode; and a calculating portion configured to calculate a surface potential of the photosensitive member on the basis of an output of said first detecting portion an output of said second detecting portion and an output of said third detecting portion.

5. A device according to claim 4, wherein said calculating portion determines charge Qp of the surface of the photosensitive member producing potentials Va1 and Va2 is determined by the following equation, $$Q_p = \left(C_{s1} - C_{s2} - \frac{C_{s1}C_{s2}}{C_a}\right) \cdot \frac{C_p V_{a1} V_{a2}}{C_{s1}V_{a1} - C_{s2}V_{a2}}$$

where Va1 is a potential of said first electrode, Va2 is a potential of said second electrode, Cs1 is an electrostatic capacity between said first electrode and said third electrode, Cs2 is an electrostatic capacity between said second electrode and said third electrode, Cp is an electrostatic capacity of the photosensitive member, Ca is an electrostatic capacity between said first electrode and said second electrode, wherein said calculating portion calculates the surface potential of the photosensitive member by Qp and Cp.

6. A detecting device for detecting a surface potential of a photosensitive member, said detecting device comprising:

a first electrode adapted to be positioned with a space relative to a surface of the photosensitive member;

a second electrode adapted to be positioned relative to the surface of the photosensitive member at a distance from said first electrode away from the surface;

a third electrode position at the distance from said first electrode away from the surface of the photosensitive member;

a first detecting portion configured to detect induced charge in said first electrode;

a second detecting portion configured to detect induced charge in said second electrode;

a third detecting portion configured to detect induced charge in said third electrode; and a calculating portion configured to calculate a surface potential of the photosensitive member on the basis of an output of said first detecting portion, an output of said second detecting portion and an output of said third detecting portion.

7. A device according to claim 6, wherein said calculating portion determines charge Qp of the surface of the photosensitive member producing the induced charges Qa1, Qa2, Qa3, where Qa1 is induced charge produced in said first electrode, Qa2 is induced charge produced in said second electrode, Qa3 is induced charge produced by said third electrode, Cp is an electrostatic capacity of the photosensitive member, Ca is an electrostatic capacity between said first electrode and said second electrode, $$Q_p = \frac{2C_p}{C_a} \cdot \frac{Q_{a1}Q_{a2}Q_{a3}}{2Q_{a2}Q_{a3} - Q_{a1}Q_{a3} - Q_{a1}Q_{a2}}$$

wherein the surface potential of the photosensitive member is calculated by Qp and Cp.

8. An image forming apparatus comprising:

a photosensitive member;

an image forming station configured to form an electrostatic image on a surface of said photosensitive member;

a first electrode adapted to be positioned with a space relative to a surface of the photosensitive member;

a second electrode adapted to be positioned relative to the surface of the photosensitive member at the distance from said first electrode away from the surface;

a third electrode electrically grounded and provided at a position remoter from said photosensitive member than said first electrode and said second electrode;

a first detecting portion configured to detect induced charge in said first electrode by the electrostatic image on said photosensitive member;

a second detecting portion configured to detect induced charge in said second electrode by the electrostatic image on said photosensitive member;

a calculating portion configured to calculate a surface potential of the photosensitive member on the basis of an output of said first detecting portion and an output of said second detecting portion.

9. An image forming apparatus comprising:

a photosensitive member;

an image forming portion for forming an electrostatic latent image on a surface of said photosensitive member;

a first electrode adapted to be positioned with a space relative to a surface of the photosensitive member;

a second electrode adapted to be positioned relative to the surface of the photosensitive member at a distance from said first electrode away from the surface;

a third electrode position at a predetermined distance from said first electrode away from the surface of the photosensitive member;

a first detecting portion configured to detect induced charge in said first electrode;

a second detecting portion configured to detect induced charge in said second electrode;

a third detecting portion configured to detect induced charge in said third electrode; and a calculating portion configured to calculate a surface potential of the photosensitive member on the basis of an output of said first detecting portion, an output of said second detecting portion and an output of said third detecting portion.

10. An image forming apparatus comprising:

a photosensitive member;

an image forming portion for forming an electrostatic latent image on a surface of said photosensitive member;

a first electrode adapted to be positioned with a space relative to a surface of the photosensitive member;

a second electrode adapted to be positioned relative to the surface of the photosensitive member at the distance from said first electrode away from the surface;

a third electrode position at the distance from said first electrode away from the surface of the photosensitive member;

a first detecting portion configured to detect induced charge in said first electrode;

a second detecting portion configured to detect induced charge in said second electrode;

a third detecting portion configured to detect induced charge in said third electrode; and a calculating portion configured to calculate a surface potential of the photosensitive member on the basis of an output of said first detecting portion, an output of said second detecting portion and an output of said third detecting portion.

* * * * *